US012680730B2

(12) United States Patent
Konowalczyk

(10) Patent No.: US 12,680,730 B2
(45) Date of Patent: Jul. 14, 2026

(54) ENERGY STORAGE ARRANGEMENT AND INSTALLATIONS

(71) Applicant: OCTOPUS ENERGY HEATING LIMITED, London (GB)

(72) Inventor: Peter Konowalczyk, Greater London (GB)

(73) Assignee: Octopus Energy Heating Limited, London (GB)

( * ) Notice: Subject to any disclaimer, the term of this patent is extended or adjusted under 35 U.S.C. 154(b) by 298 days.

(21) Appl. No.: 18/275,981

(22) PCT Filed: Feb. 7, 2022

(86) PCT No.: PCT/IB2022/051073
§ 371 (c)(1),
(2) Date: Aug. 4, 2023

(87) PCT Pub. No.: WO2022/168041
PCT Pub. Date: Aug. 11, 2022

(65) Prior Publication Data

US 2024/0102696 A1 Mar. 28, 2024

(30) Foreign Application Priority Data

Feb. 7, 2021 (GB) ..... 2101678
Jul. 2, 2021 (GB) ..... 2109593
(Continued)

(51) Int. Cl.
*F24H 15/414* (2022.01)
*F24D 19/10* (2006.01)
(Continued)

(52) U.S. Cl.
CPC ..... *F24H 15/414* (2022.01); *F24D 19/1066* (2013.01); *F24H 7/02* (2013.01);
(Continued)

(58) Field of Classification Search
CPC .. F24D 11/003; F24D 11/004; F24D 11/0228; F24D 17/0015; F24D 17/0026;
(Continued)

(56) References Cited

U.S. PATENT DOCUMENTS 4,718,403 A 1/1988 McCall
4,798,059 A 1/1989 Morita
(Continued)

FOREIGN PATENT DOCUMENTS

AT 504285 A1 4/2008
CN 201191144 Y 2/2009
(Continued)

OTHER PUBLICATIONS

International Search Report and Written Opinion for International PCT Patent Application No. PCT/IB2022/051073, May 25, 2022, 10 pages.
(Continued)

*Primary Examiner* — Kidest Worku
(74) *Attorney, Agent, or Firm* — Snell & Wilmer LLP

(57) ABSTRACT

There is provided a hot water supply system including: a controllable hot water supply outlet having when fully opened a given flowrate; a thermal energy store, containing an energy storage medium comprising a phase change material to store energy as latent heat, that is configured to receive energy from a source of renewable energy; a renewable energy source; the hot water supply system being operable, under the control of the processor, to heat water that is to be supplied to the hot water outlet to a target system supply temperature using a selection of one or more of the renewable energy source, energy from the thermal energy store, and optionally an auxiliary water heater intermediate the thermal energy store and the hot water supply outlet; wherein the thermal energy store has an energy storage
(Continued)

capacity, when fully charged, that is sufficient to provide hot water to the hot water outlet, at the given flowrate, and at the target system supply temperature for a period of at least 8 minutes, and preferably at least 10 minutes; wherein the renewable energy source is also configured to provide building heating under control of the processor; the processor being configured to: monitor actual demand for hot water from the hot water supply system; predict future demand for hot water from the hot water supply system based on the monitored actual demand; pre-charge the thermal energy store so that sufficient energy will be stored in the thermal energy store to satisfy the predicted demand; and to temporarily divert heat from the renewable energy source to charge the phase change material rather than to provide building heating. A corresponding method is also provided.

14 Claims, 7 Drawing Sheets

(30) Foreign Application Priority Data

| | | |
|---|---|---|
| Jul. 2, 2021 | (GB) | 2109594 |
| Jul. 2, 2021 | (GB) | 2109596 |
| Jul. 2, 2021 | (GB) | 2109597 |
| Jul. 2, 2021 | (GB) | 2109598 |
| Jul. 2, 2021 | (GB) | 2109599 |
| Jul. 2, 2021 | (GB) | 2109600 |
| Aug. 2, 2021 | (GB) | 2111088 |

(51) Int. Cl.
*F24H 7/02* (2022.01)
*F24H 15/152* (2022.01)
*F24H 15/164* (2022.01)
*F24H 15/262* (2022.01)

(52) U.S. Cl.
CPC ..... *F24H 15/152* (2022.01); *F24H 15/164* (2022.01); *F24H 15/262* (2022.01); *F24D 2200/12* (2013.01); *F24D 2200/14* (2013.01); *F24D 2220/042* (2013.01)

(58) Field of Classification Search
CPC .. F24D 17/02; F24D 19/1054; F24D 19/1057; F24D 19/1066; F24D 19/1072; F24D 19/1075; F24D 2200/08; F24D 2200/12; F24D 2200/14; F24D 2220/042; F24D 2220/044; F24D 2220/10; F24H 15/152; F24H 15/156; F24H 15/164; F24H 15/174; F24H 15/225; F24H 15/262; F24H 15/265; F24H 15/414; F24H 4/04; F24H 7/02; F24H 7/04; F24H 7/0441; F28D 20/02; F28D 20/021; F28D 20/028; F28D 2021/0068; F28F 2265/26; Y02B 10/20; Y02B 10/70; Y02E 60/14
See application file for complete search history.

(56) References Cited

U.S. PATENT DOCUMENTS

| | | | | |
|---|---|---|---|---|
| 2011/0271953 | A1 | 11/2011 | Wortmann et al. | |
| 2012/0095605 | A1* | 4/2012 | Tran | G05D 23/1923 700/285 |
| 2013/0146587 | A1* | 6/2013 | McDonald | H05B 1/02 219/494 |
| 2013/0266300 | A1* | 10/2013 | Kreutzman | F24H 9/2021 392/501 |
| 2013/0327313 | A1 | 12/2013 | Arnold | |
| 2014/0102124 | A1 | 4/2014 | Ben-Yaacov et al. | |
| 2015/0276265 | A1* | 10/2015 | Davari | F24H 15/156 700/300 |
| 2017/0211862 | A1 | 7/2017 | Slack et al. | |
| 2018/0038616 | A1 | 2/2018 | Scheers et al. | |
| 2019/0293303 | A1* | 9/2019 | Zhang | F24D 17/02 |
| 2021/0318027 | A1 | 10/2021 | Boros et al. | |

FOREIGN PATENT DOCUMENTS

| | | | |
|---|---|---|---|
| CN | 201265954 | Y | 7/2009 |
| CN | 203758014 | U | 8/2014 |
| CN | 106802024 | A | 6/2017 |
| CN | 111189348 | A | 5/2020 |
| CN | 111750528 | A | 10/2020 |
| CN | 111811142 | A | 10/2020 |
| DE | 29921889 | | 12/1999 |
| DE | 10006564 | A1 | 8/2000 |
| DE | 10151253 | C1 | 11/2002 |
| DE | 102007003797 | A1 | 7/2008 |
| DE | 102008043030 | A1 | 4/2010 |
| DE | 102014225693 | A1 | 6/2016 |
| EP | 0007538 | A1 | 2/1980 |
| EP | 1684035 | | 7/2006 |
| GB | 2509354 | A | 7/2014 |
| GB | 2514128 | | 11/2014 |
| GB | 2514179 | | 11/2014 |
| GB | 2609051 | B | 7/2023 |
| JP | S5812992 | A | 1/1983 |
| JP | H01256792 | A | 10/1989 |
| JP | H0526514 | A | 2/1993 |
| JP | H1144495 | A | 2/1999 |
| JP | 2005-009841 | A | 1/2005 |
| JP | 2012002469 | A | 1/2012 |
| JP | 2012-180993 | A | 9/2012 |
| JP | 2015-185025 | A | 10/2015 |
| KR | 20100030141 | A | 3/2010 |
| KR | 20160047788 | | 5/2016 |
| WO | 2020209979 | A2 | 10/2020 |

OTHER PUBLICATIONS

Japanese Patent Office (English Translation) Notice of Reasons for Refusal for co-pending Japanese Patent Application No. 2023-547563, dated Jun. 28, 2024, 24 pages.
UK IPO Search Report and Written Opinion dated Jun. 15, 2023 for GB2307232.5.
UK IPO Search Report and Written Opinion dated Aug. 20, 2021 for GB2109593.0.
UK IPO Search Report and Written Opinion dated Aug. 12, 2021 for GB2109594.8.
UK IPO Search Report and Written Opinion dated Aug. 10, 2021 for GB2109596.3.
UK IPO Search Report and Written Opinion dated Aug. 10, 2021 for GB2109597.1.
UK IPO Search Report and Written Opinion dated Aug. 10, 2021 for GB2109598.9.
UK IPO Exam Report dated Feb. 14, 2023 for GB2109599.7.
UK IPO Search Report and Written Opinion dated Aug. 10, 2021 for GB2109599.7.
UK IPO Search Report and Written Opinion dated Aug. 20, 2021 for GB2109600.3.
UK IPO Search Report and Written Opinion dated Sep. 24, 2021 for GB2111088.7.
UK IPO Search Report and Written Opinion dated Jan. 16, 2023 for GB2215387.8.
UK IPO Search Report and Written Opinion dated Feb. 20, 2023 for GB2300970.7.
UK IPO Search Report and Written Opinion dated Apr. 25, 2023 for GB2304349.0.
T. Prud'homme, D. Gillet, "Advanced control strategy of a solar domestic hot water system with a segmented auxiliary heater",

(56) References Cited

OTHER PUBLICATIONS

Elsevier Science B.V., Energy and Buildings 33 (2001). pp. 463-475.

* cited by examiner

ENERGY STORAGE ARRANGEMENT AND INSTALLATIONS

TECHNICAL FIELD

The present disclosure variously relates to methods, systems and apparatus for use in helping consumers reduce their energy usage, and in particular to energy storage arrangements, installations and systems including such arrangements, and corresponding methods.

BACKGROUND

According to Directive 2012/27/EU buildings represent 40% of the final energy consumption and 36% of $CO_2$ emissions. The EU Commission report of 2016 "Mapping and analyses of the current and future (2020-2030) heating/cooling fuel deployment (fossil/renewables)" concluded that in EU households, heating and hot water alone account for 79% of total final energy use (192.5 Mtoe). The EU Commission also report that, "according to 2019 figures from Eurostat, approximately 75% of heating and cooling is still generated from fossil fuels while only 22% is generated from renewable energy". To fulfil the EU's climate and energy goals, the heating and cooling sector must sharply reduce its energy consumption and cut its use of fossil fuels. Heat pumps (with energy drawn from the air, the ground or water) have been identified as potentially significant contributors in addressing this problem.

In many countries, there are policies and pressures to reduce carbon footprint. For example, in the UK in 2020 the UK Government published a whitepaper on a Future Homes Standard, with proposals to reduce carbon emissions from new homes by 75 to 80% compared to existing levels by 2025. In addition, it was announced in early 2019 that there would be a ban on the fitment of gas boilers to new homes from 2025. It is reported that in the UK at the time of filing 78% of the total energy used for the heating of buildings comes from gas, while 12% comes from electricity.

The UK has a large number of small, 2-3 bedroom or less, properties with gas-fired central heating, and most of these properties use what are known as combination boilers, in which the boiler acts as an instantaneous hot water heater, and as a boiler for central heating. Combination boilers are popular because they combine a small form factor, provide a more or less immediate source of "unlimited" hot water (with 20 to 35 kW output), and do not require hot water storage. Such boilers can be purchased from reputable manufactures relatively inexpensively. The small form factor and the ability to do without a hot water storage tank mean that it is generally possible to accommodate such a boiler even in a small flat or house—often wall-mounted in the kitchen, and to install a new boiler with one man day's work. It is therefore possible to get a new combi gas boiler installed inexpensively. With the imminent ban on new gas boilers, alternative heat sources will need to be provided in place of gas combi boilers. In addition, previously fitted combi boilers will eventually need to be replaced with some alternative.

Although heat pumps have been proposed as a potential solution to the need to reduce reliance on fossil fuels and cut CO2 emissions, they are currently unsuited to the problem of replacing gas fired boilers in smaller domestic (and small commercial) premises or a number of technical, commercial and practical reasons. They are typically very large and need a substantial unit on the outside of the property. Thus they cannot easily be retro-fitted into a property with a typical combi boiler. A unit capable of providing equivalent output to a typical gas boiler would currently be expensive and may require significant electrical demand. Not only do the units themselves cost multiples of the equivalent gas fired equivalent, but also their size and complexity means that installation is technically complex and therefore expensive. A further technical problem is that heat pumps tend to require a significant time to start producing heat in response to demand, perhaps 30 seconds for self-checking then some time to heat up—so a delay of 1 minute or more between asking for hot water and its delivery. For this reason, attempted renewable solutions using heat pumps and/or solar are typically applicable to large properties with room for a hot water storage tank (with space demands, heat loss and *legionella* risk).

There therefore exists a need to provide a solution to the problem of finding a suitable technology to replace gas combi boilers, particularly for smaller domestic dwellings.

More generally, further developments are sought for broadening the applicability of heat pumps. Aspects of the present disclosure provide solutions in respect of these long felt wants.

Other concerns also arise from the need to reduce the amount of carbon dioxide released into the atmosphere and more generally to reduce the amount of energy wasted by households.

SUMMARY

In a first aspect there is provided a hot water supply system including:

a controllable hot water supply outlet having when fully opened a given flowrate; a thermal energy store, containing an energy storage medium comprising a phase change material to store energy as latent heat, that is configured to receive energy from a source of renewable energy;

a renewable energy source; the hot water supply system being operable, under the control of the processor, to heat water that is to be supplied to the hot water outlet to a target system supply temperature using a selection of one or more of the renewable energy source, energy from the thermal energy store, and optionally an auxiliary water heater intermediate the thermal energy store and the hot water supply outlet; wherein the thermal energy store has an energy storage capacity, when fully charged, that is sufficient to provide hot water to the hot water outlet, at the given flowrate, and at the target system supply temperature for a period of at least 8 minutes, and preferably at least 10 minutes; wherein the renewable energy source is also configured to provide building heating under control of the processor; the processor being configured to: monitor actual demand for hot water from the hot water supply system; predict future demand for hot water from the hot water supply system based on the monitored actual demand; pre-charge the thermal energy store so that sufficient energy will be stored in the thermal energy store to satisfy the predicted demand; and to divert heat from the renewable energy source to charge the phase change material rather than to provide building heating.

With such a system it is possible to use energy more efficiently by avoiding the need to call, for example, on the auxiliary water heater. It may also be easier to rely exclusively, or more largely, on energy from renewable sources and to reduce reliance on fossil fuels. By configuring the renewable energy source to provide building heating under control of the processor, and the processor to divert heat from the renewable energy source to charge the phase change material rather than to provide building heating further energy saving may be possible. For example, if say a heat pump is used to provide building heating, e.g., space heating, it may be more energy efficient, cheaper, or "greener", to temporarily divert heat from the heat pump to charge the PCM, rather than using that heat to heat the building.

The source of renewable energy may be a solar water heating arrangement or a heat pump. The described hot water supply system facilitates the use of a heat pump as a primary energy source, particularly for smaller domestic installations as previously described, but also offers a means to integrate a PCM energy store into a solar water heating arrangement and potentially reduce reliance on networked energy supplies that may derive from fossil fuels.

The renewable energy source may be a solar water heating arrangement or a heat pump.

The source of renewable energy from which the thermal energy store is configured to receive energy may be the renewable energy source.

The energy store may include an electrical heating element to enable the phase change material to be charged using heat from the electrical heating element. This is particularly beneficial where the processor is able to take advantage of low supply tariffs for electricity, but it is also adds resilience for when the renewable energy source is unavailable.

The processor may be configured to decide when and how much to charge the PCM based on predicted future demand, and taking account of the cost of the energy to be used. Although users may be keen to rely on renewable energy rather than fossil fuels, they may also be interested in the monetary cost of running their water heating system—and sometimes their interest in monetary cost may dominate.

The thermal energy store optionally includes sufficient phase change material to store between 5 and 10 MJoules as latent heat. With an energy storage capacity in this range, it should be possible to keep the physical size of the energy store down to a manageable scale (so that it can be accommodated within a typical small dwelling, for example), while still being able to store sufficient heat, as latent heat, to satisfy even quite significant predicted demand for hot water The processor may be configured to use data from one or more occupancy sensors in predicting future demand for hot water from the hot water supply system. By taking account of current occupancy, the processor may better estimate future demand, for example by revising up or down an initial prediction based on historic data for the time/day/season.

The processor may be configured to use forecast weather information in predicting future demand for hot water from the hot water supply system. This may, for example, include a greater predicted demand for hot water in the summer months, when it is hot rather than when it is cold, because historically the household may take more showers when it is hot than when it is cold.

The processor may be configured to use data from one or more ambient temperature sensors in predicting future demand for hot water from the hot water supply system. Knowledge of actual ambient temperatures may enable better predictions to be made than, for example, may be generated when taking account of weather forecast data, because the actual ambient climatic conditions may differ significantly from weather forecast data (which will tend to be area-specific at best, rather than location specific).

The hot water supply system may serve a single household, and the processor may be configured to use calendar and schedule information of occupants of the household in predicting future demand for hot water from the hot water supply system. By enabling the processor to use calendar and schedule information, better informed predictions are likely to be possible, and hence more nearly optimum usage of energy may be realised.

According to a second aspect, there is provided a method of controlling a heating appliance in a hot water supply system, the hot water supply system having a controllable hot water supply outlet having when fully opened a given flowrate, and the heating appliance including: a thermal energy store, containing an energy storage medium comprising a phase change material to store energy as latent heat, that is configured to receive energy from a source of renewable energy; a renewable energy source; the hot water supply system being operable, under the control of the processor, to heat water that is to be supplied to the hot water outlet to a target system supply temperature using a selection of one or more of the renewable energy source, energy from the thermal energy store, and optionally an auxiliary water heater intermediate the thermal energy store and the hot water supply outlet; wherein the thermal energy store has an energy storage capacity, when fully charged, that is sufficient to provide hot water to the hot water outlet, at the given flowrate, and at the target system supply temperature for a period of at least 8 minutes, and preferably at least 10 minutes; wherein the renewable energy source is also configured to provide building heating under control of the processor, the method comprising: monitoring actual demand for hot water from the hot water supply system; predicting future demand for hot water from the hot water supply system based on the monitored actual demand; and pre-charging the thermal energy store so that sufficient energy will be stored in the thermal energy store to satisfy the predicted demand; and the processor diverting heat from the renewable energy source to charge the phase change material rather than to provide building heating.

The method may further comprise using an electrical heating element within the energy store to charge the phase change material using heat from the electrical heating element.

The method may further comprise deciding when and how much to charge the PCM based on predicted future demand, and taking account of the cost of the energy to be used.

The method may further comprise using data from one or more occupancy sensors in predicting future demand for hot water from the hot water supply system.

The method may further comprise using forecast weather information in predicting future demand for hot water from the hot water supply system.

The method may further comprise using data from one or more ambient temperature sensors in predicting future demand for hot water from the hot water supply system.

In the method according to any variant of the second aspect, the hot water supply system may serve a single household, and the method may further comprise using calendar and schedule information of occupants of the household in predicting future demand for hot water from the hot water supply system.

In the method according to any variant of the second aspect, the thermal energy store includes sufficient phase change material to store between 5 and 10 MJoules as latent heat.

BRIEF DESCRIPTION OF THE DRAWINGS

Embodiments of various aspects of the disclosure will now be described by way of example only, with reference to the accompanying drawings, in which.

SPECIFIC DESCRIPTION

Figure 1:
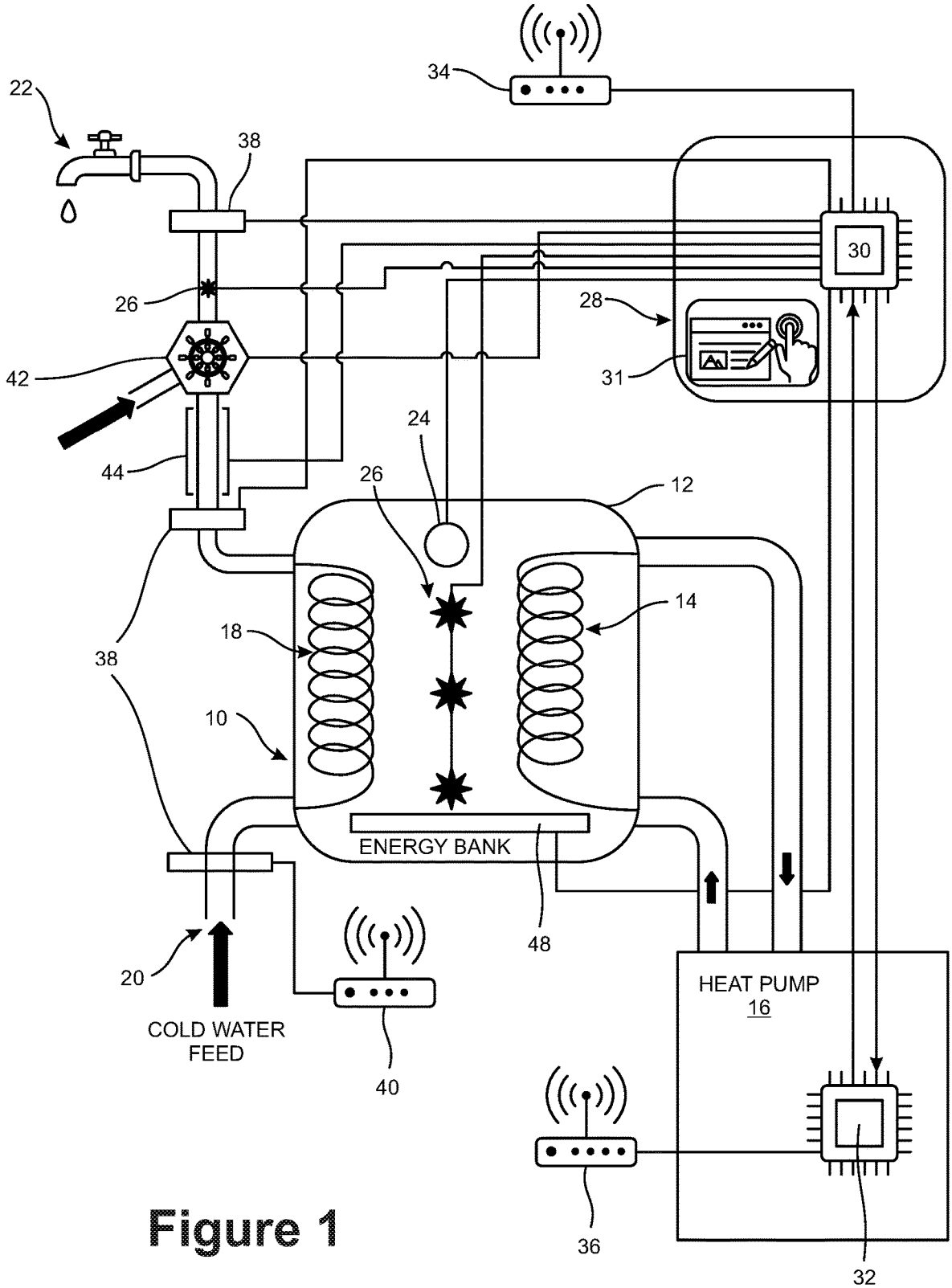
FIG. 1 is a schematic diagram showing an energy bank including a phase change material and a heat exchanger coupled to a heat pump energy source, the energy bank including one or more sensors to provide measurement data indicative of the amount of energy stored as latent heat in the phase change material.

One of the many constraints on the applicability of heat pumps is their relatively limited ability to satisfy demand for hot water—at least when compared to instantaneous gas and electric water heaters, such as combi boilers, compared to their strengths as sources of heat for space heating. As noted earlier, for the typically modestly sized dwellings of the UK, space heating demands are commonly as low as 6 kW, whereas gas combi boilers even in modest one or two bed flats can typically provide 20 kW to 30 kW for instant water heating. The 6 kW space heating demand is readily achievable in Europe with even an air source heat pump, but a unit that could provide 20 to 30 kW would be unacceptably large and expensive. Heat pumps suffer from a further limitation in respect of their application to domestic hot water supplies, and that is the long lag between a heat pump receiving a start signal and hot water actually being supplied by the heat pump. Generally, this lag is well over a minute, and sometimes as much as two minutes or more. While that doesn't at first sight sound significant, when one realises that for things like handwashing—one of the most common uses of hot water in a domestic setting, the average time for which a hot tap runs is between 30 seconds and 1 minute—so it becomes clear that heat pumps have a significant hurdle to overcome.

In addition, heat pumps generally cannot support repeated starts without a significant delay between those starts, and their internal processors will not act on a start up request if it follows too quickly on a run period. This means of course that, in addition to the previously discussed inevitable lag that occurs from sending a start request to heat being delivered, there may be times when there is a demand for heat from the heat pump, and a start request is sent, but no heat is made available.

Typically, these two problems are addressed by storing hot water—in a hot water storage tank, so that it is available on demand. But that solution is unattractive for smaller dwellings, such as the kinds of one, two and three bed properties in the UK that currently make use of gas combination boilers—and which are almost universally installed without an external hot water storage tank.

One technology which has potential to improve the applicability of heat pumps to the demands of, in particular, domestic hot demands, is thermal energy storage—but not in the guise of hot water storage.

Such an alternative form of thermal energy storage is the use of phase change materials (PCMs). As the name suggests, phase change materials are materials which exhibit a thermally induced phase change: heating the PCM to its phase transition temperature results in energy being stored as latent (rather than sensible) heat. Many different PCMs are known, the choice for any particular application being dictated by, among other things, the required operating temperature, cost constraints, health and safety restrictions (taking account of toxicity, reactivity, flammability, stability, etc. of the PCM, and the constraints that these impose on such as things as materials needed for containment of the PCM). With an appropriate choice of PCM, a thermal energy storage arrangement can be designed so that energy from a heat pump is available for instantaneous heating of water for a (domestic) hot water system, thereby helping address the slow start problem inherent with the use of a heat pump without the need for a bulky hot water tank.

We will now introduce and describe an energy storage arrangement based on the use of PCMs, and particularly suited for use in installations in which a heat pump is to be used to heat water in a hot water supply. Such an energy storage arrangement may include a heat exchanger comprising an enclosure, and within the enclosure: an input-side circuit for connection to an energy source such as a heat pump, an output-side circuit for connection to an energy sink such as a hot water supply installation, and a phase-change material for the storage of energy.

The input-side circuit receives liquid heated by the heat source, in our case a heat pump—but potentially a solar water heating installation, and provided the liquid is hotter than the material inside the heat exchanger, energy is transferred from the liquid into the material within the heat exchanger. Likewise, energy from the material within the heat exchanger is transferred to liquid in the output-side circuit provided the liquid is cooler than the material within the heat exchanger. Of course, if there is no flow through the output-side circuit, the amount of energy transferred out of the heat exchanger is limited, so that most of the input energy remains within the heat exchanger. In our case, the heat exchanger contains a phase change material, for example, a paraffin wax or a salt-hydrate (examples of suitable materials are discussed later) so that the input energy is largely transferred to the PCM. With an appropriate choice of phase change material and heat pump operating temperature, it becomes possible to use energy from the heat pump to "charge" the energy "bank" represented by the PCM. Optionally, the energy supply from the heat pump may be supplemented by including one or more electrical heating elements in the heat exchanger, the heating elements being controlled by a processor of the system, and being used, for example, when a low-cost tariff applies to the electricity supply, or for example local or domestic electricity production such as from wind, hydraulic or photovoltaic generation, is able to provide "cheap" energy when there an anticipated or expected future need for hot water.

In a hot water supply system including such a thermal energy store it can be useful to predict future demand for hot water from the hot water supply system, and based on such a prediction to pre-charge the thermal energy store so that sufficient energy will be stored in the thermal energy store to satisfy the predicted demand. By doing this it may be possible to avoid a need to call upon other sources of energy, such as an additional instantaneous heat source using energy supplied from a networked supply using fossil fuels. It may also be possible to use lower cost energy to pre-charge the energy store than will be available when the demand for hot water eventually materialises.

We will now describe a hot water supply system including a thermal energy store, containing an energy storage medium comprising a phase change material to store energy as latent heat, that is configured to receive energy from a source of renewable energy, and which includes a processor configured to predict future demand for hot water from the hot water supply system, based on the monitored actual demand, and to pre-charge the thermal energy store so that sufficient energy will be stored in the thermal energy store to satisfy the predicted demand.

FIG. 1 shows schematically a thermal energy store or energy bank 10 including a heat exchanger, the energy bank comprising an enclosure 12. Within the enclosure 12 are an input-side circuit 14 of the heat exchanger for connection to a source of renewable energy—shown here as a heat pump 16, an output-side circuit 18 of the heat exchanger for connection to an energy sink—shown here as a hot water supply system connected to a cold-water feed 20 and including one or more outlets 22. Each of the outlets 22 has, when fully opened, a given flowrate. Such given flowrates may be in the range of 5 to 15 litres per minute, for example, such a 7, 10, 12 or 15 litres per minute.

Within the enclosure 12 is a phase-change material for the storage of energy using the latent heat of the phase change material. The thermal energy store has an energy storage capacity, when fully charged, that is sufficient to provide hot water to one or more of the hot water outlets 22, at the given flowrate, and at the target system supply temperature for a usefully long period. That period will generally be in excess of 5 minutes, preferably at least 7 or 8 minutes, and preferably at least 10, 12 or 15 minutes. Preferably the thermal energy store includes sufficient phase change material to store between 5 and 10 MJoules as latent heat.

The energy bank 10 preferably also includes one or more status sensors 24, to provide a measurement indicative of a status of the PCM. For example, one or more of the status sensors 24 may be a pressure sensor to measure pressure within the enclosure. One characteristic of phase change materials which must be accommodated when designing systems that use them is the volume change which occurs on transition between phases, for example expansion on the phase change between liquid and solid, and contraction on the phase change between solid and liquid. Typically, the volume change is of the order of 10%. This volume change can be considered a disadvantage which must be accommodated with careful design of enclosures used to contain the phase change materials, but the volume change can also be used positively. By including one or more sensors to provide a measurement of pressure within the PCM enclosure it is possible to provide a processor with data from which the processor may determine a status of the phase change material. For example, the processor may be able to determine an energy storage value for the phase change material.

In addition to, or as an alternative to, the measurement of pressure within the enclosure as a means of determining an energy storage amount of the phase change material, it is possible to use changes in the optical or sonic properties that occur in the PCM on changes of phase. Examples of these alternative approaches will be described later, but first we will consider the use of pressure sensing as a means to gather information on the energy storage state of the PCM.

Preferably the enclosure also includes one or more temperature sensors 26 to measure temperatures within the PCM. If, as is preferred, multiple temperature sensors are provided within the PCM, these are preferably spaced apart from the structure of the input and output circuits of the heat exchanger, and suitably spaced apart within the PCM to obtain a good "picture" of the state of the PCM.

The energy bank 10 has an associated system controller 28 which includes a processor 30. The controller may be integrated into the energy bank 10, but is more typically mounted separately. The controller 28 may also be provided with a user interface module 31, as an integrated or separate unit, or as a unit that may be detachably mounted to a body containing the controller 28. The user interface module 31 typically includes a display panel and keypad, for example in the form of a touch-sensitive display. The user interface module 31, if separate or separable from the controller 28 preferably includes a wireless communication capability to enable the processor 30 of controller 28 and the user interface module to communicate with each other. The user interface module 31 is used to display system status information, messages, advice and warnings to the user, and to receive user input and user commands—such as start and stop instructions, temperature settings, system overrides, etc.

The status sensor(s) is/are coupled to the processor 30, as is/are the temperature sensor(s) 26 if present. The processor 30 is also coupled to a processor/controller 32 in the heat pump 16, either through a wired connection, or wirelessly using associated transceivers 34 and 36, or through both a wired and a wireless connection. In this way, the system controller 28 is able to send instructions, such as a start instruction and a stop instruction, to the controller 32 of the heat pump 16. In the same way, the processor 30 is also able to receive information from the controller 32 of the heat pump 16, such as status updates, temperature information, etc.

The hot water supply installation also includes one or more flow sensors 38 which measure flow in the hot water supply system. As shown, such a flow sensor may be provided on the cold-water feed 20 to the system, and or between the output of the output-side circuit 18 of the heat exchanger. Optionally, one or more pressure sensors may also be included in the hot water supply system, and again the pressure sensor(s) may be provided upstream of the heat exchanger/energy bank, and/or downstream of the heat exchanger/energy bank—for example alongside one or more of the one or more flow sensors 38. The or each flow sensor, the or each temperature sensor, and the or each pressure sensor is coupled to the processor 30 of the system controller 28 with either or both of a wired or wireless connection, for example using one or more wireless transmitters or transceivers 40. Depending upon the nature(s) of the various sensors 24, 26, and 38, they may also be interrogatable by the processor 30 of the system controller 28.

Optionally, as shown, the hot water supply installation also includes a cold-water mixing valve 42, under the control of the processor 30, for mixing cold water from a cold-water feed with hot water from the thermal energy store 10. In this way, hot water can be delivered at a target system supply temperature controlled by the processor 30. A thermometer 26 is provided in the output of the valve 42 or just downstream of the valve 42, and coupled to the processor 30, so that the processor can monitor the temperature of the water supplied by the valve, and therefore regulate the temperature. Preferably, as shown, the installation also includes an auxiliary instantaneous water heater 44 intermediate the energy bank 10 and the mixing valve 42, under the control of the processor 30, so that water may be heated, or heat added, even when the energy store 10 is discharged and even when the heat pump 16 is unable to provide heat. The auxiliary instantaneous water heater 44 is preferably an electric heater, using either inductive or resistive heating, although another energy source, such as gas, may be used instead.

Optionally, as shown, the energy bank 10 may include, within the enclosure 12, an electrical heating element 48 which is controlled by the processor 30 of the system controller 28, and which may on occasion be used as an alternative to the heat pump 16 to recharge the energy bank. Optionally, the electrical heating element 48 is connected to a renewable energy source, such as a local or domestic electricity supply from a photovoltaic array or a wind or water turbine.

The hot water supply system is operable, under the control of the processor 30, to heat water that is to be supplied to the hot water outlet(s) 22 to a target system supply temperature using a selection of one or more of the renewable energy source 16, energy from the thermal energy store 10, and optionally the auxiliary instantaneous water heater 44.

The processor 30 is configured to monitor actual demand for hot water from the hot water supply system. For example, recording the time, duration, flow rates and energy content of the hot water supplied. The processor 30 is also configured to predict future demand for hot water from the hot water supply system based on the monitored actual demand. The processor 30 may also, in predicting future demand for hot water from the hot water supply system, be configured to use calendar and schedule information of occupants of the household served by the hot water supply system, for example where the hot water supply system serves a single household.

Where the source of renewable energy and/or the renewable energy source is/are a solar water heating installation (s), the processor may be arranged to predict the optimum periods within which to call on energy from the solar water heating installation. Typically, such installations include some form of energy storage, generally in the form of a hot water reservoir—and as such, it is unusual to find such installations in the smaller dwellings of the type that are more generally served by gas combi boilers. But in larger dwellings, and in some of the smaller dwellings, such installations are occasionally used, and it is contemplated that energy may be diverted either from the hot water store, or hot system fluid from the solar installation (which would generally be fed only to a heat exchanger in the hot water store) be used to charge the PCM under the control of the processor 30.

The processor may also be configured to use knowledge about occupancy levels, for example from one or more occupancy sensors (movement sensors, such as acoustic or PIR sensors, activity sensors, electrical activity sensors, etc.), "smart device" data, such as from "smart speakers", or from a "smart residence" installation or application, in predicting future demand.

Preferably, the processor is configured to use forecast weather information in predicting future demand for hot water from the hot water supply system.

Preferably, the processor is configured to use data from one or more ambient temperature sensors in predicting future demand for hot water from the hot water supply system.

Based on the predicted future demand for hot water, the processor 30 is configured to pre-charge the thermal energy store so that sufficient energy will be stored in the thermal energy store to satisfy the predicted demand.

Preferably the processor has access to data on energy costs, including tariff data for energy supplied from utilities networks, and the cost of running the source of renewable energy (e.g., heat pump). Preferably the processor has access to one or more data networks, such as the Internet, and or to utility suppliers' databases. Preferably the processor is configured to decide when and how much to charge the PCM based on predicted future demand, and taking account of the cost of the energy to be used. The processor 30 may be provided with a machine learning algorithm to learn behaviours of the household and to support predictions of demand.

In FIG. 1, the heat pump 16 is shown as supplying heat only to the energy store 10, and not supplying energy directly into the hot water supply system. This is the preferred arrangement, with fluid flowing between a heat exchanger in the heat pump and the heat exchanger coil 14 in the energy bank. But it will be appreciated that a heat exchanger in the heat pump could be supplied with water to be heated for the hot water supply system, and water thus heated could be fed into the hot water supply system bypassing the energy bank—a mixer valve optionally being inserted in the hot water supply system downstream of the energy bank 10, and preferably located between the energy bank and the mixing valve 42, and in particular between the energy bank and the auxiliary instantaneous water heater 44 if present.

FIG. 1 is merely a schematic, and only shows connection of the heat pump to a hot water supply installation. It will be appreciated that in many parts of the world there is a need for space heating as well as hot water. Typically, therefore the heat pump 16 will also be used to provide space heating. An exemplary arrangement in which a heat pump both provides space heating and works with an energy bank for hot water heating will be described later in the application. For ease of description the following description of a method of operation of an energy bank according to an aspect of the invention, for example as illustrated in FIG. 1, applies equally to the energy bank installation whether or not the associated heat pump provides space/building heating. Preferably in such an arrangement, the processor is configured to divert heat from the renewable energy source to charge the phase change material rather than to provide space/building heating.

It will be appreciated that the previously described arrangements in various guises constitute hot water supply systems having one or more controllable hot water supply outlets each having, when fully opened a given flowrate, and the hot water supply system including: a thermal energy store, containing an energy storage medium comprising a phase change material to store energy as latent heat, that is configured to receive energy from a source of renewable energy; and a renewable energy source. And in various guises these hot water supply system are operable, under the control of the processor, to heat water that is to be supplied to the hot water outlet to a target system supply temperature using a selection of one or more of the renewable energy source, and energy from the thermal energy store, and optionally the auxiliary instantaneous water heater 44; the thermal energy store having an energy storage capacity, when fully charged, that is sufficient to provide hot water to the hot water outlet, at the given flowrate, and at the target system supply temperature for a usefully long period. That period will generally be in excess of 5 minutes, preferably at least 7 or 8 minutes, and preferably at least 10, 12 or 15 minutes.

The target system supply temperature will generally be in the range of 38 to 50 degrees Celsius, but may on occasion be increased to as much as 60 degrees Celsius or more, for example during periodic disinfection cycles, to kill *Legionella* bacteria, preferably under the control of the processor 30.

Such installations and arrangements may be arranged to provide a method of controlling a heating appliance in a hot water supply system, comprising: monitoring actual demand for hot water from the hot water supply system; predicting future demand for hot water from the hot water supply system based on the monitored actual demand; and pre-charging the thermal energy store so that sufficient energy will be stored in the thermal energy store to satisfy the predicted demand.

Figure 2:
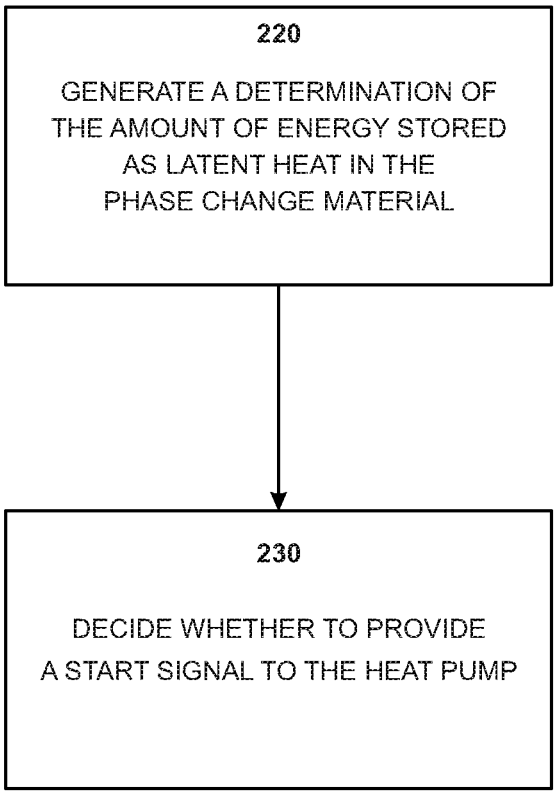
FIG. 2 is a high-level flow chart for a method performed by an installation including an energy bank such as that of FIG. 1.

A method of controlling an installation according to an aspect of the invention will now be described with reference to FIG. 2. FIG. 2 is a simplified flow chart illustrating various actions performed by a processor associated with an installation according to any variant of the third or fourth aspect of the invention.

The method begins at 220 with generating a determination of the amount of energy stored as latent heat in the phase change material, based on information from one or more of the status sensors 24.

Then, at step 230, based at least in part on that determination, the processor decides whether to provide a start signal to the heat pump. Various factors which the processor may take into account in addition to the status of the PCM are introduced and discussed later in the specification.

Figure 3:
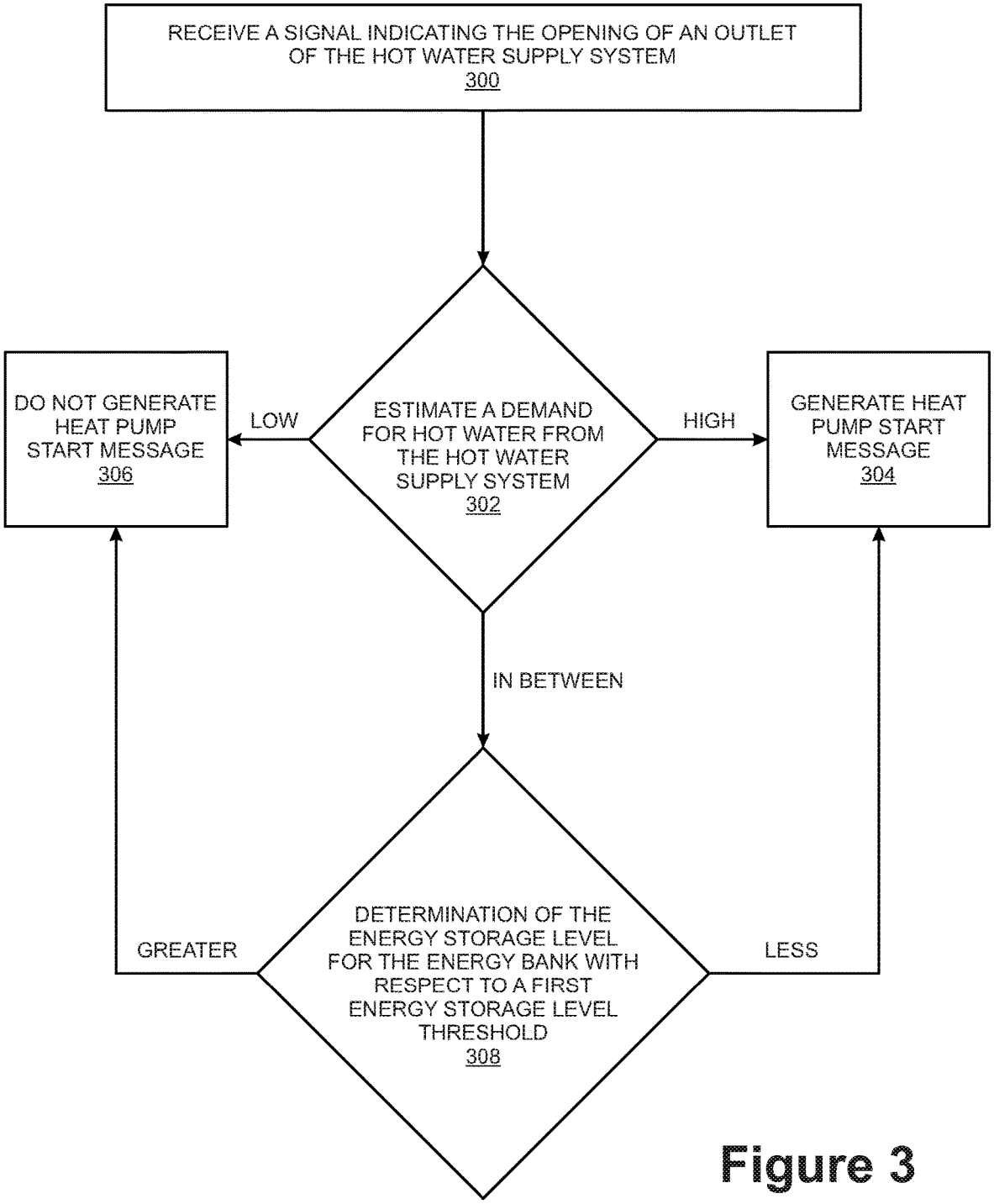
FIG. 3 is a high-level flow chart for another method performed by an energy bank such as that of FIG. 1.

FIG. 3 is another simplified flow chart illustrating various actions performed by a processor associated with an installation according to any variant of the third or fourth aspect of the invention.

The method begins at 300 with the processor receiving a signal indicating the opening of an outlet of the hot water supply system. The signal may for example come from a flow sensor 38 in the hot water supply system, or in the cold-water feed to the hot water system. At 302 the processor estimates a demand for hot water from the hot water supply system, based for example on an identity or type of the outlet that has been opened, or based on an instantaneous flow rate. The processor compares the estimated demand with a first threshold demand level. If the estimated demand is above the first threshold demand level, the processor generates at 304 a heat pump start message. If the estimated demand is below the first threshold demand level, the processor compares the estimated demand with a second threshold demand level, lower than the first. If the estimated demand is below the second threshold demand level, the processor determines at 306 to not to generate a heat pump start message.

If the estimated demand is between the first and the second threshold demand levels, at 308 the processor takes account to the energy storage level of the energy bank. This may involve the processor establishing afresh the energy storage level of the energy bank, or the processor may use recently generated information on the energy storage level of the energy bank.

If the determination of the energy storage level for the energy bank is greater than a first energy storage level threshold, the processor determines at 304 not to generate a heat pump start message. Conversely, if the determination of the energy storage level for the energy bank is less than the first energy storage level threshold, the processor determines to generate a heat pump start message at 306.

Figure 4:
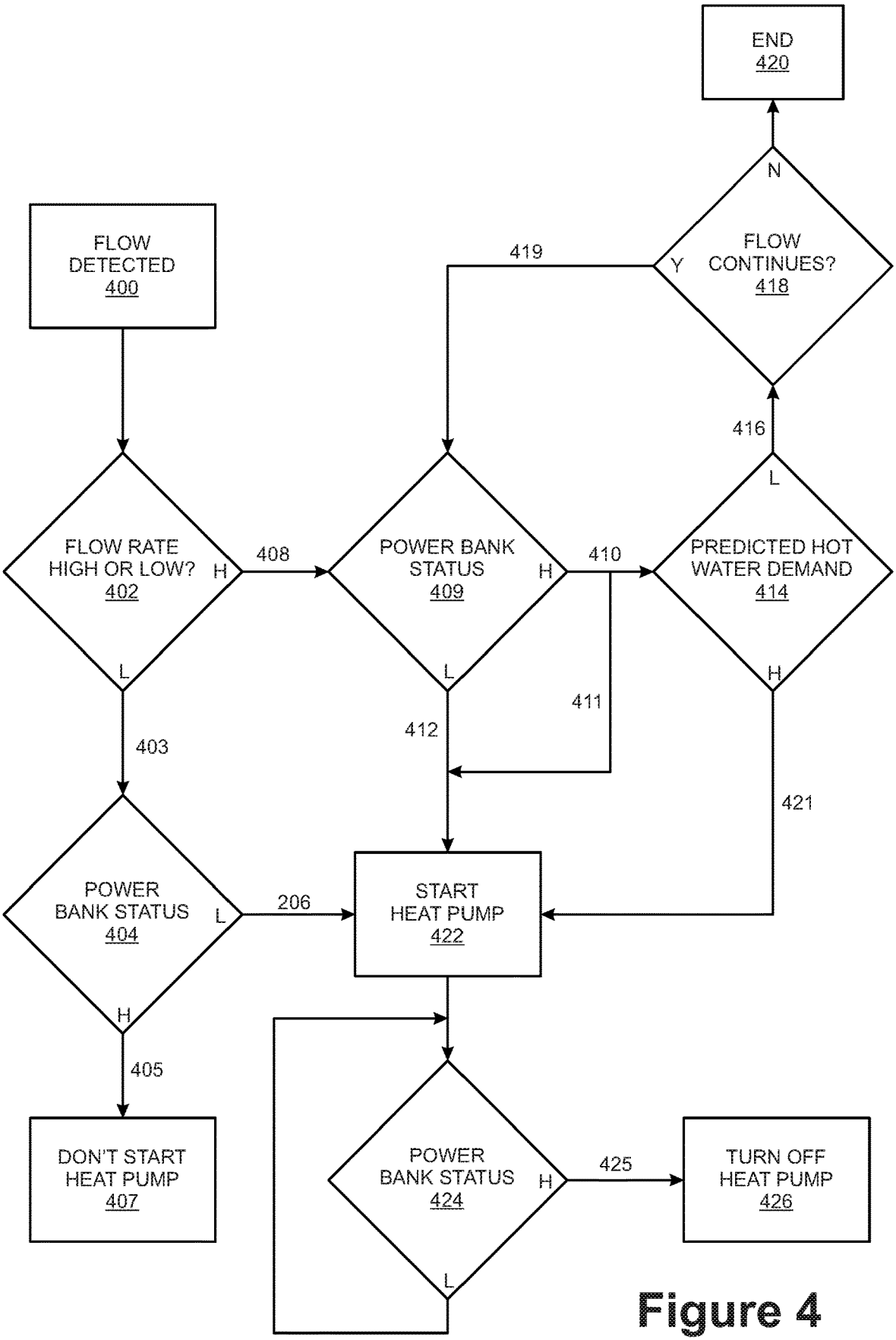
FIG. 4 is a flow chart for another method performed by an energy bank such as that of FIG. 1.

A method of controlling an installation according to an aspect of the invention will now be described with reference to FIG. 4. FIG. 4 is a simplified flow chart illustrating various actions performed by a processor associated with an energy bank such as that illustrated in FIG. 1. The process begins at step 400 when the processor 30 detects a flow of water in the hot water supply system. Detection is preferably based on data from a flow sensor such as flow sensor 38 of FIG. 1, but could alternatively be based on data from a pressure sensor in the hot water supply system. The relevant sensor may be configured continuously to supply measurement data to the processor 30, or may be configured only to report changes in the measurement data, or the processor may continuously or periodically (for example at least once per second) read the relevant sensor(s).

At step 402 the processor 30 determines whether the flow rate indicated by the data from the sensor(s) indicate a high or a low flow, for example above or below a particular threshold. The processor may use more than one threshold to categorize the flow rate as high, medium, or low, or the categories could include very high, high, medium, and low. There may also be a category of very low or de minimus flow. The processor 30 may also be provided with information (e.g. in the form of a database, model, or MLA) about flow rates and flow signatures for each of the outlets 22, or each of the outlet types, of the hot water supply system (for example using a technique such as that described later in this patent application), the processor then characterising the detected flow rate as associated with a particular one of the outlets 22 or a particular type (shower outlet, bath outlet, kitchen sink outlet, washbasin outlet, handbasin outlet, for example).

If the determination indicates that the demand for hot water is low 403, the processor then, in step 404, takes account of the status of the power bank 10, based on information from at least the status sensor 24. The processor 30 may interrogate the status sensor 24 (e.g., a pressure sensor) at this stage, or may check a recently updated energy bank status, in either case determining whether the energy bank is in a high energy state 405 (with a large proportion of the potential latent heat capacity of the energy bank available for use) or in a low energy state 406 (with a small proportion of the potential latent heat capacity of the energy bank available for use). The processor may also take account of information from the temperature sensor(s) 26, for example to take account of sensible energy stored in the energy bank 10. If the processor 30 determines a high energy state, the processor determines not to send a start instruction to the heat pump, and the process terminates at 407. If the processor 30 determines a low energy state, the processor may then determine at 406 to send 422 a start instruction to the heat pump.

If the determination indicates that the demand for hot water is high 408, the processor may then, in step 409, takes account of the status of the power bank 10, based on information from at least the status sensor 24. The processor 30 may interrogate the status sensor 24 at this stage, or may check a recently updated energy bank status, in either case determining whether the energy bank is in a high energy state 410 (with a large proportion of the potential latent heat capacity of the energy bank available for use) or in a low energy state 412 (with a small proportion of the potential latent heat capacity of the energy bank available for use).

The processor may also take account of information from the temperature sensor(s) 26, for example to take account of sensible energy stored in the energy bank 10. If the processor 30 determines a high energy state 410, the processor optionally determines a predicted hot water demand in step 414. But the processor may alternatively be configured to issue an instruction to start the heat pump at 422 based simply on the magnitude of the flow rate, and without predicting hot water demand (as indicated by the cross-hatched arrow 411).

In step 414, the processor 30 may take account of the determined identity (i.e., a particular outlet) or type of water outlet to predict hot water demand. For example, if the outlet is identified as a kitchen sink outlet, it is unlikely that the tap will be run for more than 30 seconds to a minute. Whereas, if the outlet is a bath tap, the tap is likely to remain open for several minutes with a demand for perhaps 120 to 150 litres of hot water.

In the first situation, the processor 30 will determine at 416 not to send a start signal to the heat pump, but will instead either end the process, or more preferably continue to monitor the flow rate at 418 to see how long the flow continues. If the flow stops within the predicted time, the process ends at 420, but if the flow of water continues for longer than predicted, the processor moves at 419 back to step 409. In the second situation, the processor 30 will determine at 421 to send 422 a start signal to the heat pump (and the arrow 411 indicates a decision to start the heat pump based simply on the instantaneous flow rate or the identification of the outlet (or outlet type) as being associated with the withdrawal of significant volumes of hot water from the hot water supply system.

After starting the heat pump at 422 (either from the determination at 406 or at 421), the processor 30 continues at 424 to monitor (periodically or continuously) the power bank status, until the status reaches some threshold level of charge 425, at which the processor sends a signal 426 to turn off the heat pump.

Figure 5:
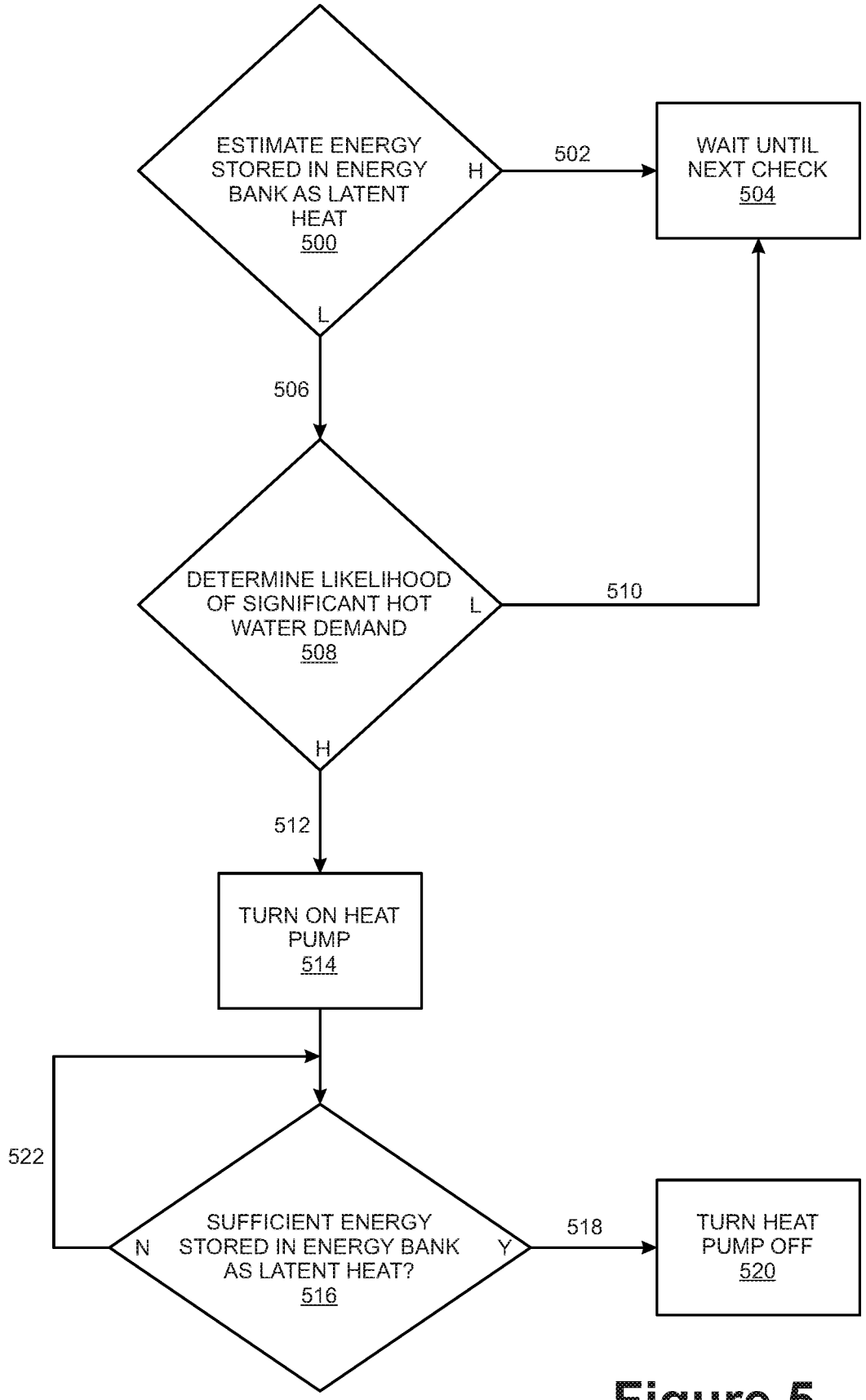
FIG. 5 is a flow chart for another method performed by an energy bank such as that of FIG. 1.

FIG. 5 is another simplified flow chart illustrating various actions performed by a processor associated with the energy bank, such as processor 30 of FIG. 1. Unlike the method described with reference to FIG. 4, the method of FIG. 5 is not dependent on detection of a call for hot water, i.e. not dependent on the opening of an outlet of the hot water system. Generally, FIG. 5 illustrates a method of controlling an installation, the method comprising generating a determination of the amount of energy stored as latent heat in the phase change material; and based on that determination deciding whether to provide a start signal to the heat pump. Although, as will be seen, an optional but preferred step may take place between the step of generating a determination of the amount of energy stored as latent heat in the phase change material, and the step of, based on that determination, deciding whether to provide a start signal to the heat pump.

The method begins at step 500 with the processor 30 estimating the amount of energy stored in the phase change material of the energy bank 10 as latent heat. The amount of heat may be an absolute amount in kJoules, but may equally well be simply a measure of the proportion of the potential latent heat capacity that is currently available. In other words, the processor may effectively determine the proportion of the phase change material that is still in the phase with the higher energy state. So, for example, if the phase change material is a paraffin wax, with a phase change from liquid to solid, the liquid phase is the higher energy phase, incorporating the latent heat of fusion, and the solid phase is the lower energy phase, the latent heat of fusion having been given up on solidification.

If the processor determines that the amount of energy stored as latent heat is sufficient 502, i.e., exceeds some predetermined threshold, the method moves to step 504 at which the process halts, and the processor awaits the next check 500.

If the processor determines that the amount of energy stored as latent heat is not sufficient 506, i.e., is at or below some predetermined threshold the method moves to step 508. At step 508, the processor determines the likelihood of significant hot water demand within a coming period of time (e.g., within the next half hour, hour, 2, 3, or 4 hours). The period of time considered is a factor of the heat capacity of the energy bank, the size of the energy shortfall determined, and the capacity of the heat pump to recharge the energy bank under those circumstances. It will be appreciated that the demand period considered should be great enough to enable the heat pump to recharge the energy bank sufficiently within the period so that the energy bank will be optimally charged (possibly fully charged) to be able to cope with the predicted or anticipated demand. Conversely, the heat pump should not be being used to recharge the energy bank so long in advance of the expected/predicted energy demand that the energy bank will lose a significant quantity of energy through radiation, conduction, or convection.

The processor may rely on a database, model, calendar or schedule, and any and all of these may include learned behaviours and patterns of behaviour, and scheduled events (such as scheduled absences or events scheduled for some other location). The processor may also have access to local weather reports, for example provided (pushed or received) over the Internet, or in a radio transmission, and/or an external thermometer.

If the processor determines 510 that there is a low likelihood of significant hot water demand within the period, the method moves to step 504 at which the process halts, and the processor awaits the next check 500.

If the processor determines 512 that there is a high likelihood of significant hot water demand within the period, the method moves to step 514 at which the heat pump is turned on: for example, the processor 30 sends an instruction to the heat pump 16, so that the processor 32 of the heat pump initiates the heat pump starting procedure, after which the heat pump starts to supply heat to the input side of the heat exchanger, thereby putting energy into the phase change material. The processor then, in step 516, repeatedly determines whether sufficient energy is now stored in the energy bank as latent heat of the phase change material. Once the processor has determined 518 that sufficient energy is now stored in the energy bank as latent heat of the phase change material, the method moves to step 520, and the heat pump is turned off, for example by the processor 30 sending an appropriate instruction. As long as the processor determines 522 that insufficient energy is stored, the method continues.

Referring back to FIG. 1, instead of or in addition to providing one or more status sensors 24 to measure pressure within the enclosure, other sensor types can be provided to measure optical properties, such as transparency, absorption, refraction, refractive index, of the PCM, because various of these change with phase transitions in the PCM. In addition, various of these properties may exhibit a wavelength dependence that changes with a change of phase.

The energy bank may therefore further comprise one or more optical sources to launch light into the phase change material, and the one or more status sensors 24 may include an optical sensing arrangement to detect light launched from the optical source (s) after the light has passed through the phase change material. The change between phases in the phase change material gives rise to reversible changes in optical properties of the phase change material, and hence observing optical properties of the PCM can be used to glean information about the state of the PCM. Preferably, optical properties of the PCM are observed in several areas of the PCM, and preferably in different directions within the material. For example, optical sources and sensors may be arranged so that light from the source(s) passes lengthwise through the PCM at one or more positions, and other source(s) and sensor(s) may be arranged so that light from the source(s) passes width wise through the PCM at one or more positions and in one or more orientations (through the width and or through the thickness).

The optical source(s) may be controllable to produce light of different colours and the optical sensing arrangement(s) may be configured to detect at least some of different colours. By selecting appropriate colours of light, based on the particular PCM chosen for any application, it may be possible to determine more accurately the extent to which the phase of the PCM has changed.

Preferably the optical source comprises a plurality of separately activatable devices.

Coupling the optical sensing arrangement to a processor which is configured to estimate an amount of energy stored in the phase change material based on information received from the optical sensing arrangement provides a means of determining the amount of energy stored as latent heat within the PCM, and this information can be used in controlling the heat pump. In particular, such information may make possible more efficient and appropriate use of the heat pump in charging the PCM energy bank.

As a further option, the one or more status sensors 24 to provide measurement data indicative of the amount of energy stored as latent heat in the phase change material may include an acoustic source configured to launch sound into the phase change material, and an acoustic sensing arrangement to detect sound launched from the acoustic source after the sound has passed through the phase change material. The change between phases in the phase change material gives rise to reversible changes in sound absorbing properties of the phase change material, and hence observing sonic properties of the PCM can be used to glean information about the state of the PCM. The acoustic source may be configured to produce ultrasound.

Figure 6:
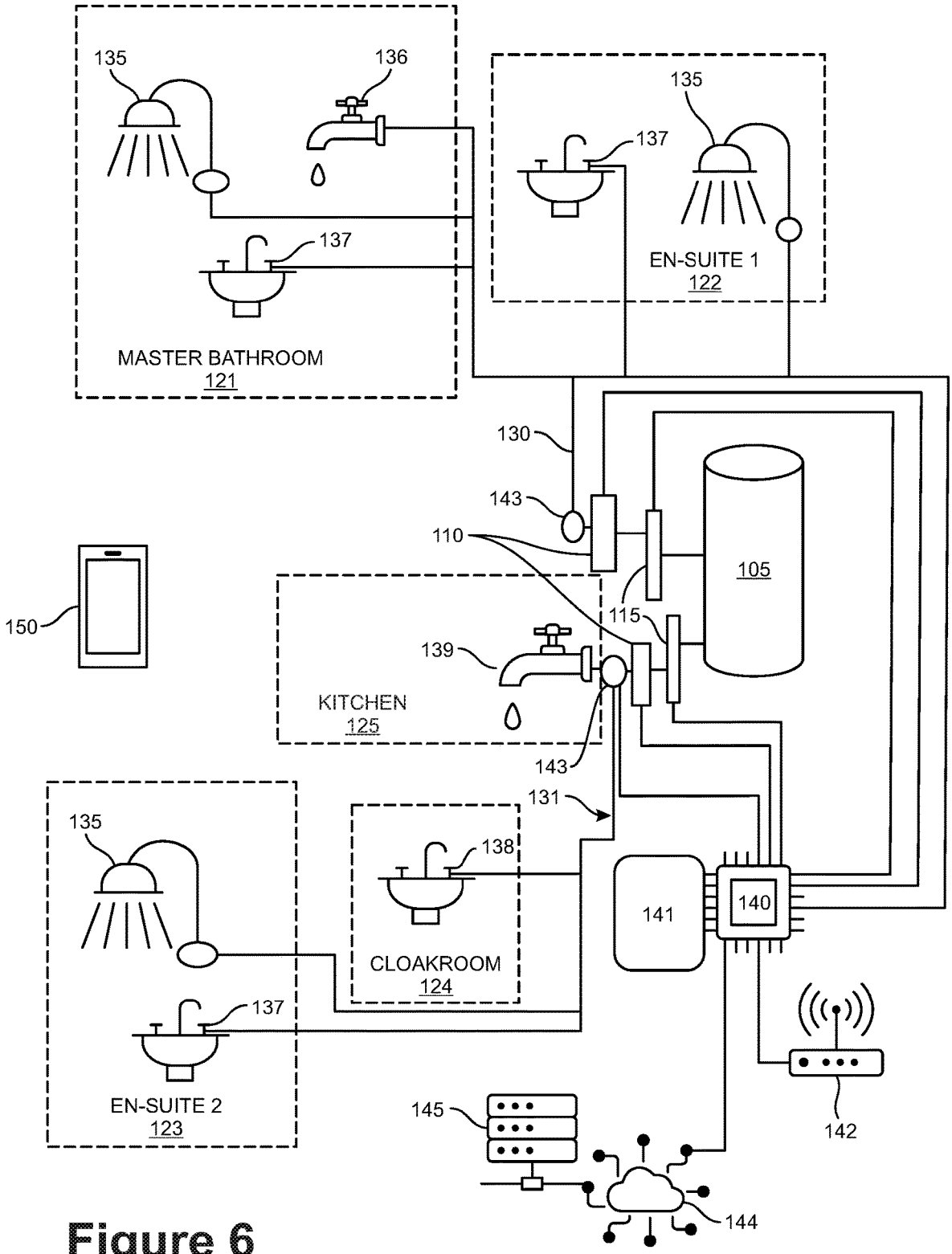
FIG. 6 is a schematic diagram showing an in-building water supply installation according to an aspect of the disclosure.

FIG. 6 shows schematically an in-building water supply installation 100 having a plurality of controllable water outlets (various taps and showers that will be described more fully later), a supply of water 105, and in a water flow path between the supply of water 105 and the plurality of controllable water outlets, at least one flow measurement device 110 and at least one flow regulator 115, and a processor 120 operatively connected to the at least one flow measurement device 110 and the at least one flow regulator 115. The illustrated water supply installation represents a dwelling with a master bathroom 121, a first en-suite shower room 122, a second en-suite shower room 123, a cloakroom 124, and a kitchen 125. The master bathroom and the first en-suite shower room may be on one floor of the dwelling, whereas the cloakroom, second en-suite and kitchen may be on another floor of the dwelling.

In such a situation, it may be convenient to have, as shown, two separate circuits, 130 and 131, to supply water to the various outlets.

The master bathroom 121 is shown as including a shower outlet 135, a bath tap or faucet 136, and a tap 137 for a sink. The en-suite shower rooms 122 and 123 also include a shower outlet 135, and a tap 137 for a sink. Conversely, the cloakroom contains just a W.C. (not shown) and a hand basin with a tap 138. Finally, the kitchen has a sink with a tap 139.

A processor, or system controller, 140, with an associated memory 141, is coupled to the at least one flow measurement device 110 and the at least one flow regulator 115. It will be appreciated that each of the two circuits 130 and 131 is provided with a respective flow measurement device 110 and flow regulator 115 The processor is also optionally connected to one or more temperature sensors 143, one for each of the circuits 130 and 131. This processor may be associated with an energy bank as previously described.

The processor is also coupled to an RF transceiver 142, which includes at least one RF transmitter and at least one RF receiver, for bidirectional communication via Wi-Fi, Bluetooth, or the like, and preferably also to the Internet 144 for connection to a server or central station 145, and optionally to a cellular radio network (such as LTE, UMTS, 4G, 5G, etc.). By means of the RF transceiver 142 and/or the connection to the Internet, the processor 140 is able to communicate with a mobile device 150, which may for example be a smart phone or tablet, for use by an installation engineer in mapping the in-building water supply installation. The mobile device 150 includes software, such as a specific app, that co-operates with corresponding software in the system controller 140 and also potentially within server 145, to facilitate the mapping methods according to embodiments of the invention, and in particular to synchronize actions taken by the engineer to a clock of the system controller 140/server 145. The memory 141 contains code to enable the processor to perform a method of mapping an in-building water supply installation processor, for example during a process of commissioning a new installation. For the sake of description, consider FIG. 6 to show a hot water supply installation, although it could equally be a cold-water supply installation.

During the commissioning process an engineer will be asked by the processor/system controller 140 to define all hot water outlets (for e.g., tap, shower, bath, kitchen). The system controller will ask the engineer to fully open each of the outlets (taps, shower outlets, etc.) and will monitor the resulting water flow, by means of the relevant flow measurement device 110. During this process, the relevant flow measurement device 110 will measure water flow and the processor will receive these data and will add the results to a database. Based on this information, the system will subsequently be able to provide the most efficient flow into each single tap, by controlling the relevant flow control device 115, when any outlet is opened.

A method of mapping an in-building water supply installation according to a first aspect of the disclosure will now be described with reference to FIG. 6.

The method comprises opening a first of the plurality of controllable water outlets and processing signals from the at least one flow measurement device 110 with the processor 140 at least until a first flow characteristic is determined, and then closing the first of the plurality of controllable water outlets. The opening of the first of the plurality of controllable water outlets is preferably instructed by the processor or system controller 140 sending a message to the mobile device 150 carried by the relevant engineer. For example, the instruction may be sent by Wi-Fi and tell the engineer to open the hot bath tap 136 in the master bathroom 121. The engineer, carrying the mobile device 150, then goes to the master bathroom and opens the hot bath tap 136 fully. The mobile device may provide the engineer with a prompt, preferably audible and with a countdown, to tell the engineer when precisely to open the tap. Alternatively, the app on the mobile device may be configured to accept an input from the engineer, such as the pressing or release of a button, at the moment that the tap 136 is opened. In either case, the app may capture a local time for the prompt or the moment, and then send this local time, along with the identity of the relevant controllable outlet, to the system controller 140 or server 145. In this way, delays in the prompt reaching the mobile device 150 or of the timing of the instruction reaching the controller 140 or server 145 can be accounted for (the mobile device 150 and the system controller 140 preferably go through some handshaking procedure, either before or after the mapping process, so that wither offsets between the clocks of the two devices can be eliminated or they can also be accounted for).

The engineer may then work her way around the premises selecting an outlet identity from a list or menu on the app, or entering an unambiguous identifier, opening each of the outlets in turn. Or the system controller may already have been provided with a list of all the taps, etc. (generally "controllable outlets") and may prompt the engineer, by sending another message to the mobile device 150, to go to the relevant outlet. The app preferably includes the option for the engineer to send a message to the system controller 140/server 145, that she is in place and ready to receive an instruction to open the next controllable outlet. The process is then repeated for each of the other hot water outlets, until all the outlets and their flow characteristics—namely the lag before flow is detected, the rate of rise of flow, the maximum flow rate, and any other identifiable characteristics have been captured and stored in a database. By using the characteristics stored in the database, the processor 140 is then subsequently able to identify the opening of a particular one of the plurality of controllable water outlets based on the similarity of a detected flow characteristic to a respective flow characteristic.

The processor is also provided with some rules concerning preferred flow rates and, optionally, flow durations, based on the type of outlet (bath tap, kitchen tap, basin tap, cloakroom tap) and its location (main bathroom, en-suite, child's room, adult's room, cloakroom, kitchen, for example), and use these rules, along with the outlet identity recognised from the detected flow characteristics, to determine a target flow rate. The targeted flow rate is then imposed by the system controller 140 by controlling the relevant flow controller 115, and preferably monitored by the corresponding flow measurement device 110. In this way, by controlling at least one flow regulator, based on the identification of the relevant outlet, the processor 140 is able control a supply of water to the identified controllable water outlet.

Each of the respective flow characteristic may include a respective stable flow rate. The method may then further comprise configuring the processor 140 to control the at least one flow regulator 115 to impose at least a 10% cut in the flow rate to each of each of the plurality of controllable water outlets, based on the respective stable flow rate. Optionally, the method may further comprise configuring the processor 140 to control the at least one flow regulator 115 to impose at least a 10% cut in the flow rate, based on respective stable flow rate, to any of the plurality of controllable water outlets whose respective stable flow rate is greater than 7 litres per minute. This is of particular application for taps that serve basins in bathrooms, en suites, and most particularly cloakrooms, where taps are often largely used to provide water for handwashing—which can be achieved effectively with quite modest flow rates.

The above-described technique of mapping a hot water supply installation may be used to populate a database or train logic, such as a neural network or machine learning algorithm (MLA), which may be used by a processor associated with an energy bank as previously described, so that the processor is better able to identify a particular outlet or outlet type from detected flow behaviour and hence to more readily estimate a demand for hot water from a hot water supply. This in turn may improve the efficiency of controlling the heat pump and of using the energy bank.

Having described an energy bank and the installation and operation of an energy bank in a hot water supply installation, we will now consider how the energy bank and heat pump may be integrated into both a hot water supply system and a space heating arrangement.

Figure 7:
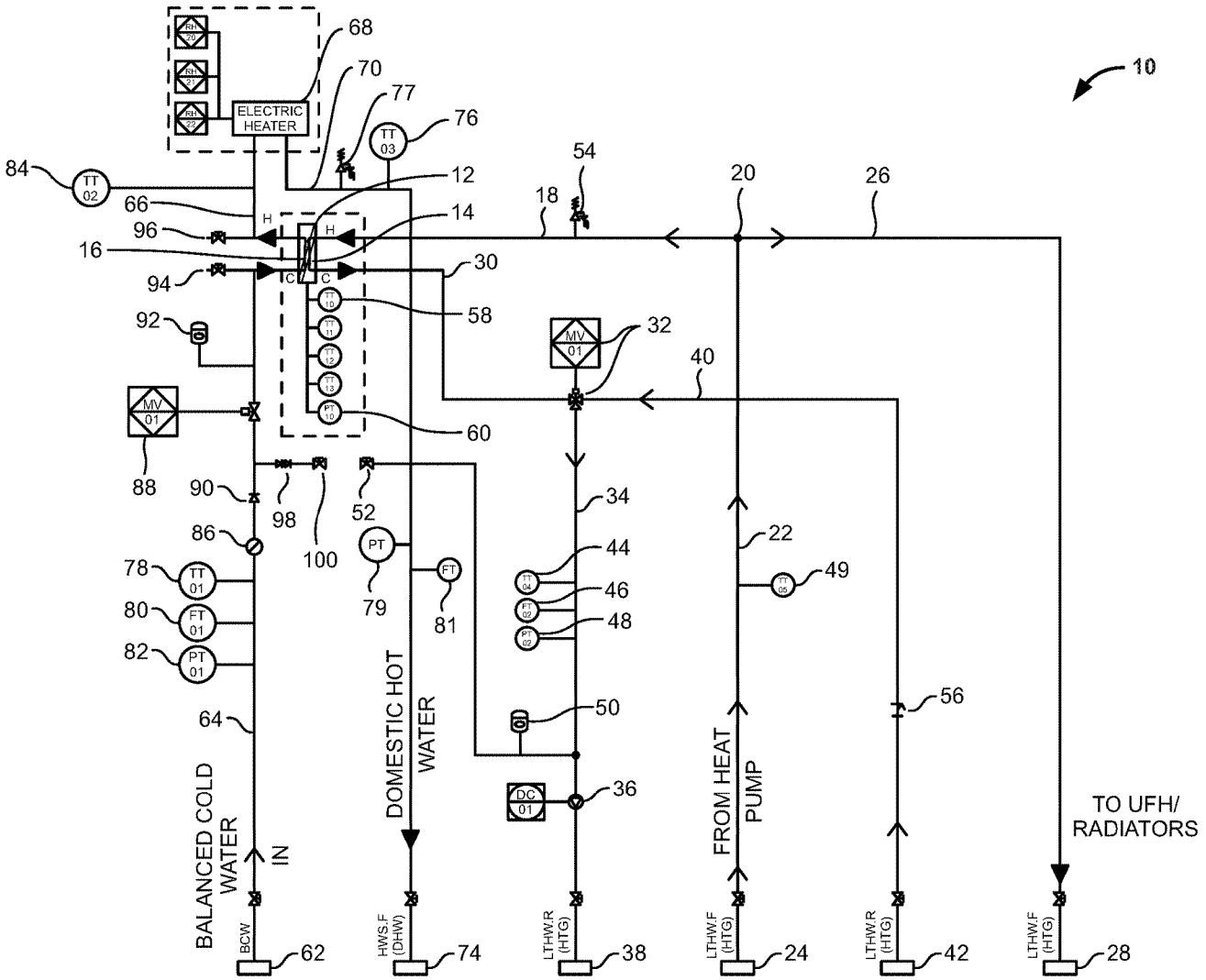
FIG. 7 is a schematic diagram showing a potential arrangement of components of an interface unit, incorporating energy bank according to an aspect of the disclosure.

FIG. 7 shows schematically a potential arrangement of components of an interface unit 10 according to an aspect of the disclosure. The interface unit interfaces between a heat pump (not shown in this Figure) and an in-building hot water system. The interface unit includes a heat exchanger 12 comprising an enclosure (not separately numbered) within which is an input-side circuit, shown in very simplified form as 14, for connection to the heat pump, and an output-side circuit, again shown in very simplified form as 16, for connection to the in-building hot water system (not shown in this Figure). The heat exchanger 12 also contains a thermal storage medium for the storage of energy, but this is not shown in the Figure. In the example that will now be described with reference to FIG. 7 the thermal storage medium is a phase-change material. It will be recognised that the interface unit corresponds to he previously described energy bank. Throughout this specification, including the claims, references to energy bank, thermal storage medium, energy storage medium and phase change material should be considered to be interchangeable unless the context clearly requires otherwise.

Typically, the phase-change material in the heat exchanger has an energy storage capacity (in terms of the amount of energy stored by virtue of the latent heat of fusion) of between 2 and 5 MJoules, although more energy storage is possible and can be useful. And of course, less energy storage is also possible, but in general one wants to maximise (subject to practical constraints based on physical dimensions, weight, cost and safety) the potential for energy storage in the phase-change material of the interface unit 10. More will be said about suitable phase-change materials and their properties, and also about dimensions etc. later in this specification.

The input side circuit 14 is connected to a pipe or conduit 18 which is in turn fed from node 20, from pipe 22 which has a coupling 24 for connection to a feed from a heat pump. Node 20 also feeds fluid from the heat pump to pipe 26 which terminates in a coupling 28 which is intended for connection to a heating network of a house or flat—for example for plumbing into underfloor heating or a network of radiators or both. Thus, once the interface unit 10 is fully installed and operational, fluid heated by a heat pump (which is located outside the house or flat) passes through coupling 24 and along pipe 22 to node 20, from where, according to the setting of a 3-port valve 32, the fluid flow passes along pipe 18 to the input-side circuit 14 of the heat exchanger, or along pipe 26 and out through coupling 28 to the heating infrastructure of the premises.

Heated fluid from the heat pump flows through the input-side circuit 14 of the heat exchanger and out of the heat exchanger 12 along pipe 30. In use, under some circumstance, heat carried by the heated fluid from the heat pump gives up some of its energy to the phase change material inside the heat exchanger and some to water in the output-side circuit 16. Under other circumstances, as will be explained later, fluid flowing through the input-side circuit 14 of the heat exchanger actually acquires heat from the phase change material.

Pipe 30 feeds fluid that leaves the input-side circuit 14 to a motorized 3-port valve 32 and then, depending upon the status of the valve out along pipe 34 to pump 36. Pump 36 serves to push the flow on to the external heat pump via coupling 38.

The motorized 3-port valve 32 also receives fluid from pipe 40 which receives, via coupling 42, fluid returning from the heating infrastructure (e.g., radiators) of the house or flat.

Between the motorized 3-port valve 32 and the pump 36 a trio of transducers are provided: a temperature transducer 44, a flow transducer 46, and a pressure transducer 48. In addition, a temperature transducer 49 is provided in the pipe 22 which brings in fluid from the output of the heat pump. These transducers, like all the others in the interface unit 10, are operatively connected to or addressable by a processor, not shown, which is typically provided as part of the interface unit—but which can be provided in a separate module.

Although not illustrated in FIG. 7, an additional electrical heating element may also be provided in the flow path between the coupler 24, which receives fluid from the output of the heat pump. This additional electrical heating element may again be an inductive or resistive heating element and is provided as a means to compensate for potential failure of the heat pump, but also for possible use in adding energy to the thermal storage unit (for example based on the current energy cost and predicted for heating and/or hot water. The additional electrical heating element is also of course controllable by the processor of the system.

Also coupled to pipe 34 is an expansion vessel 50, to which is connected a valve 52 by means of which a filling loop may be connected to top up fluid in the heating circuit. Also shown as part of the heating circuit of the interface unit are a pressure relief valve 54, intermediate the node 20 and the input-side circuit 14, and a strainer 56 (to capture particulate contaminants) intermediate coupling 42 and the 3-port valve 32.

The heat exchanger 12 is also provided with several transducers, including at least one temperature transducer 58, although more (e.g., up to 4 or more) are preferable provided, as shown, and a pressure transducer 60. In the example shown, the heat exchanger includes 4 temperature transducers uniformly distributed within the phase change material so that temperature variations can be determined (and hence knowledge obtained about the state of the phase change material throughout its bulk). Such an arrangement may be of particular benefit during the design/implementation phase as a means to optimise design of the heat exchanger—including in optimising addition heat transfer arrangements. But such an arrangement may also continue to be of benefit in deployed systems as having multiple sensors can provide useful information to the processor and machine learning algorithms employed by the processor (either of just the interface unit, and/or of a processor of a system including the interface unit.

The arrangement of the cold-water feed and the hot water circuit of the interface unit 10 will now be described. A coupling 62 is provided for connection to a cold feed from a water main. Typically, before water from the water main reaches the interface unit 10, the water will have passed through an anti-syphon non-return valve and may have had its pressure reduced. From coupling 62 cold water passes along pipe to the output-side circuit 16 of the heat exchanger 12. Given that we provide a processor that is monitoring numerous sensors in the interface unit, the same processor can optionally be given one more task to do. That is to monitor the pressure at which cold water is delivered from the mains water supply. To this end, a further pressure sensor can be introduced into the cold-water supply line upstream of coupling 62, and in particular upstream of any pressure reducing arrangement within the premises. The processor can then continually or periodically monitor the supplied water pressure, and even prompt the owner/user to seek compensation from the water supply company if the water main supplies water at a pressure below the statutory minimum.

From the output-side circuit 16 water, which may have been heated by its passage through the heat exchanger, passes along a pipe 66 to an electrical heating unit 68. The electrical heating unit 68, which is under the control of the processor mentioned previously, may comprise a resistive or inductive heating arrangement whose heat output can be modulated in accordance with instructions from the processor.

The processor is configured to control the electrical heater, based on information about the status of the phase-change material and of the heat pump.

Typically, the electrical heating unit 68 has a power rating of no more than 10 kW, although under some circumstances a more powerful heater, e.g., 12 kW, may be provided.

From the electric heater 68, what will by now hot water passes along a pipe 70 to a coupling 74 to which the hot water circuit, including controllable outlets such as taps and showers, of the house or flat will be connected.

A temperature transducer 76 is provided after the electric heater 68, for example at the outlet of the electric heater 68 to provide information on the water temperature at the outlet of the hot water system. A pressure relief valve 77 is also provided in the hot water supply, and while this is shown as being located between the electric heater 68 and the outlet temperature transducer 76, its precise location is unimportant—as indeed is the case for many of the components illustrated in FIG. 7.

Also somewhere in the hot water supply line is a pressure transducer 79 and or a flow transducer 81 either of which can be used by the processor to detect a call for hot water—i.e., detect the opening of a controllable outlet such as a tap or shower. The flow transducer is preferably one which is free from moving parts, for example based on sonic flow detection or magnetic flow detection. The processor can then use information from one or both of these transducers, along with its stored logic, to decide whether to signal to the heat pump to start.

It will be appreciated that the processor can call on the heat pump to start either based on demand for space heating (e.g., based on a stored program either in the processor or in an external controller, and/or based on signals from one or more thermostats—e.g., room stats, external stats, underfloor heating stats) or demand for hot water. Control of the heat pump may be in the form of simple on/off commands, but may also or alternatively be in the form of modulation (using, for example, a ModBus).

As is the case with the heating circuit of the interface unit, a trio of transducers are provided along the cold-water feed pipe 64: a temperature transducer 78, a flow transducer 80, and a pressure transducer 82. Another temperature transducer 84 is also provided in pipe 66 intermediate the outlet of the output-side circuit 16 of the heat exchanger 12 and the electric heater 68. These transducers are again all operatively connected to or addressable by the processor mentioned previously.

Also shown on the cold-water supply line 64 are a magnetic or electrical water conditioner 86, a motorised and modulatable valve 88 (which like all the motorised valves may be controlled by the processor mentioned previously), a non-return valve 86, and an expansion vessel 92. The modulatable valve 88 can be controlled to regulate the flow of cold water to maintain a desired temperature of hot water (measured for example by temperature transducer 76).

Valves 94 and 96 may also be provided for connection to external storage tanks for the storage of cold and heated water respectively. Finally, a double check valve 98 may be provided to connect cold feed pipe 64 to another valve 100 which can be used with a filling loop to connect to previously mentioned valve 52 for charging the heating circuit with more water or a mix of water and corrosion inhibiter.

It should be noted that FIG. 7 shows various of the pipes crossing, but unless these crossing are shown as nodes, like node 20, the two pipes that are shown as cross do not communicate with each other, as should by now be clear from the foregoing description of the Figure.

Although not shown in FIG. 7, the heat exchanger 12 may include one or more additional electrical heating elements configured to put heat into the thermal storage medium. While this may seem counter intuitive, it permits the use of electrical energy to pre-charge the thermal storage medium at times when it makes economic sense to do so, as will now be explained.

It has long been the practice of energy supply companies to have tariffs where the cost of a unit of electricity varies according to the time of day, to take account of times of increased or reduced demand and to help shape customer behaviour to better balance demand to supply capacity. Historically, tariff plans were rather coarse reflecting the technology both of power generation and of consumption. But increasing incorporation of renewable energy sources of electrical power—such as solar power (e.g., from photovoltaic cells, panels, and farms) and wind power, into the power generation fabric of countries has spurred the development of a more dynamic pricing of energy. This approach reflects the variability inherent in such weather-dependent power generation. Initially such dynamic pricing was largely restricted to large scale users, increasingly dynamic pricing is being offered to domestic consumers.

The degree of dynamism of the pricing varies from country to country, and also between different producers within a given country. At one extreme, "dynamic" pricing is little more than the offering of different tariffs in different time windows over the day, and such tariffs may apply for weeks, months, or seasons without variation. But some dynamic pricing regimes enable the supplier to change prices with a day's notice or less—so for example, customers may be offered today prices for half-hour slots tomorrow. Time slots of as short as 6 minutes are offered in some countries, and conceivably the lead time for notifying consumers of forthcoming tariffs can be reduced further by including "intelligence" in energy-consuming equipment.

Because it is possible to use short- and medium-term weather predictions to predict both the amount of energy likely to be produced by solar and wind installations, and the likely scale of power demand for heating and cooling, it becomes possible to predict periods of extremes of demand. Some power generation companies with significant renewable generation capacity have even been known to offer negative charging for electricity—literally paying customers to use the excess power. More often, power may be offered at a small fraction of the usual rate.

By incorporating an electric heater into an energy storage unit, such as a heat exchanger of systems according to the disclosure, it becomes possible for consumers to take advantage of periods of low-cost supply and to reduce their reliance on electrical power at times of high energy prices. This not only benefits the individual consumer, but it is also beneficial more generally as it can reduce demand at times when excess demand must be met by burning fossil fuels.

The processor of the interface unit has a wired or wireless connection (or both) to a data network, such as the Internet, to enable the processor to receive dynamic pricing information from energy suppliers. The processor also preferably has a data link connection (e.g., a ModBus) to the heat pump, both to send instructions to the heat pump and to receive information (e.g., status information and temperature information) from the heat pump. The processor has logic which enables it* to learn the behaviour of the household, and with this and the dynamic pricing information, the processor is able to determine whether and when to use cheaper electricity to pre-charge the heating system. This may be by heating the energy storage medium using an electrical element inside the heat exchanger, but alternatively this can be by driving the heat pump to a higher-than-normal temperature—for example 60 Celsius rather than between 40 and 48 Celsius. The efficiency of the heat pump reduces when it operates at higher temperature, but this can be taken into account by the processor in deciding when and how best to use cheaper electricity.

*Because the system processor is connectable to a data network, such as the Internet and/or a provider's intranet, the local system processor can benefit from external computing power. So, for example the manufacturer of the interface unit is likely to have a cloud presence (or intranet) where computing power is provided for calculations of, for example, predicted: occupancy; activity; tariff (short/long); weather forecasts (which may be preferable to generally available weather forecasts because they can be pre-processed for easy use by the local processor, and they may also be tailored very specifically to the situation, location, exposure of the property within which the interface unit is installed); identification of false positives and/or false negatives.

To protect users from the risk of scalding by overheated water from the hot water supply system it is sensible to provide a scalding protection feature. This may take the form of providing an electrically controllable (modulatable) valve to mix cold water from the cold-water supply into hot water as it leaves the output circuit of the heat exchanger.

FIG. 7 shows schematically what might be considered the "guts" of the interface unit, but does not show any container for these "guts". An important application of interface units according to the disclosure is as a means to enable a heat pump to be used as a practical contributor to the space heating and hot water requirements of a dwelling that was previously provide with a gas-fired combination boiler (or which might otherwise have such a boiler installed), it will be appreciated that it will often be convenient both to provide a container both for aesthetics and safety, just as is the case conventionally with combi boilers. Moreover, preferably any such container will be dimensioned to fit within a form factor enabling direct replacement of a combi boiler—which are typically wall mounted, often in a kitchen where they co-exist with kitchen cabinets. Based on the form of a generally rectangular cuboid (although of course, for aesthetics, ergonomics, or safety, curved surfaces may be used for any or all of the surfaces of the container) with a height, width and depth, suitable sizes may be found in the approximate ranges: height 650 mm to 800 mm; width 350 mm to 550 mm; depth 260 mm to 420 mm; for example 800 mm high, by 500 mm wide, and 400 mm deep, although larger, and in particular taller, units may be provided for installation where these can be accommodated.

One notable distinction of interface units according to the disclosure with respect to gas combi boilers is that while the containers of the latter generally have to be made of non-combustible materials—such as steel, due to the presence of a hot combustion chamber, the internal temperatures of an interface unit will generally be considerably less than 100 Celsius, typically less than 70 Celsius, and often less than 60 Celsius. So, it becomes practical to use flammable materials such a wood, bamboo, or even paper, in fabricating a container for the interface unit.

The lack of combustion also opens up the possibility to install interface units in locations that would generally never be considered as suitable for the installation of gas combi boilers—and of course, unlike a gas combi boiler, interface units according to the disclosure, do not require a flue for exhaust gases. So, for example, it becomes possible to configure an interface unit for installation beneath a kitchen worktop, and even to make use of the notorious dead spot represented by an under counter corner. For installation in such a location the interface unit could actually be integrated into an under-counter cupboard—preferably through a collaboration with a manufacturer of kitchen cabinets. But greatest flexibility for deployment would be retained by having an interface unit that effectively sits behind some form of cabinet, the cabinet being configured to allow access to the interface unit. The interface unit would then preferably be configured to permit the circulation pump 36 to be slid out and away from the heat exchanger 12 before the circulation pump 36 is decoupled from the flow path of the input-side circuit.

Consideration can also be given to taking advantage of other space frequently wasted in fitted kitchens, namely the space beneath under-counter cupboards. There is often more a space with a height of more than 150 mm, and a depth of around 600 mm, with widths of 300, 400, 500, 600 mm or more (although allowance needs to be made for any legs supporting the cabinets). For new installations in particular, or where a combi boiler is being replaced along with a kitchen refit, it makes sense to use these spaces at least to accommodate the heat exchanger of the interface unit—or to use more than one heat exchanger unit for a given interface unit.

Particularly for interface units designed for wall mounting, although potentially beneficial whatever the application of the interface unit, it will often be desirable to design the interface unit as a plurality of modules. With such designs it can be convenient to have the heat exchanger as one of the of modules, because the presence of the phase-change material can result in the heat exchanger alone weighing more than 25 kg. For reasons of health and safety, and in order to facilitate one-person installation, it would be desirable to ensure that an interface unit can be delivered as a set of modules none of which weighs more than about 25 kg.

Such a weight constraint can be supported by making one of the modules a chassis for mounting the interface unit to a structure. For example, where an interface unit is to be wall mounted in place of an existing gas combi boiler, it can be convenient if a chassis, by which the other modules are supported, can first be fixed to the wall. Preferably the chassis is designed to work with the positions of existing fixing points used to support the combi boiler that is being replaced. This could potentially be done by providing a "universal" chassis that has fixing holes preformed according to the spacings and positions of popular gas combi boilers. Alternatively, it could be cost effective to produce a range of chassis each having hole positions/sizes/spacings to match those of particular manufacturer's boilers. Then one just needs to specify the right chassis to replace the relevant manufacturer's boiler. There are multiple benefits to this approach: it avoids the need to drill more holes for plugs to take fixing bolts—and not only does this eliminate the time needed to mark out, drill the holes and clean up, but it avoids the need to further weaken the structure of the dwelling where installation is taking place—which can be an important consideration given the low cost construction techniques and materials frequently used in "starter homes" and other low cost housing.

Preferably the heat exchanger module and the chassis module are configured to couple together. In this way it may be possible to avoid the need for separable fastenings, again saving installation time.

Preferably an additional module includes first interconnects, e.g., 62 and 74, to couple the output side circuit 16 of the heat exchanger 12 to the in-building hot water system. Preferably the additional module also includes second interconnects, e.g., 38 and 24, to couple the input side circuit 14 of the heat exchanger 12 to the heat pump. Preferably the additional module also includes third interconnects, e.g., 42 and 28, to couple the interface unit to the heat circuit of the premises where the interface unit is to be used. It will be appreciated that by mounting heat exchanger to the chassis, which is itself directly connected to the wall, rather than first mounting the connections to the chassis, the weight of the heat exchanger is kept closer to the wall, reducing the cantilever loading effect on the wall fixings that secure the interface unit to the wall.

Phase Change Materials

One suitable class of phase change materials are paraffin waxes which have a solid-liquid phase change at temperatures of interest for domestic hot water supplies and for use in combination with heat pumps. Of particular interest are paraffin waxes that melt at temperatures in the range 40 to 60 Celsius, and within this range waxes can be found that melt at different temperatures to suit specific applications. Typical latent heat capacity is between about 180 kJ/kg and 230 kJ/kg and a specific heat of perhaps 2.27 $Jg^{-1}K^{-1}$ in the liquid phase, and 2.1 $Jg^{-1}K^{-1}$ in the solid phase. It can be seen that very considerable amounts of energy can be stored taking using the latent heat of fusion. More energy can also be stored by heating the phase change liquid above its melting point. For example, when electricity costs are relatively low and it can be predicted that there will shortly be a need for hot water (at a time when electricity is likely to, or known to be going to, cost more perhaps), then it can make sense to run the heat pump at a higher-than-normal temperature to "overheat" the thermal energy store.

A suitable choice of wax may be one with a melting point at around 48 Celsius, such as n-tricosane $C_{23}$, or paraffin $C_{20}$-$C_{33}$. Applying the standard 3K temperature difference across the heat exchanger (between the liquid supplied by the heat pump and the phase change material in the heat exchanger) gives a heat pump liquid temperature of around 51 Celsius. And similarly on the output side, allowing a 3K temperature drop, we arrive at a water temperature of 45 Celsius which is satisfactory for general domestic hot water—hot enough for kitchen taps, but potentially a little high for shower/bathroom taps—but obviously cold water can always be added to a flow to reduce water temperature. Of course, if the household are trained to accept lower hot water temperatures, or if they are acceptable for some other reason, then potentially a phase change material with a lower melting point may be considered, but generally a phase transition temperature in the range 45 to 50 is likely to be a good choice. Obviously, we will want to take into account the risk of *Legionella* from storing water at such a temperature.

Heat pumps (for example ground source or air source heat pumps) have operating temperatures of up to 60 Celsius (although by using propane as a refrigerant, operating temperatures of up to 72 Celsius are possible), but their efficiencies tend to be much higher when run at temperatures in the range of 45 to 50 Celsius. So our 51 Celsius, from a phase transition temperature of 48 Celsius is likely to be satisfactory.

Consideration also needs to be given to the temperature performance of the heat pump. Generally, the maximum ΔT (the difference between the input and output temperature of the fluid heated by the heat pump) is preferably kept in the range of 5 to 7 Celsius, although it can be as high as 10 Celsius.

Although paraffin waxes are a preferred material for use as the energy storage medium, they are not the only suitable materials. Salt hydrates are also suitable for latent heat energy storage systems such as the present ones. Salt hydrates in this context are mixtures of inorganic salts and water, with the phase change involving the loss of all or much of their water. At the phase transition, the hydrate crystals are divided into anhydrous (or less aqueous) salt and water. Advantages of salt hydrates are that they have much higher thermal conductivities than paraffin waxes (between 2 to 5 times higher), and a much smaller volume change with phase transition. A suitable salt hydrate for the current application is $Na_2S_2O_3 \cdot SH_2O$, which has a melting point around 48 to 49 Celsius, and latent heat of 200/220 kJ/kg.

In terms simply of energy storage, consideration can also be given to using PCMs with phase transition temperatures that are significantly above the 40-50 Celsius range. For example, a paraffin wax, waxes being available with a wide range of melting points:

- n-henicosane $C_{24}$ which has a melting point around 40 Celsius;
- n-docosane $C_{21}$ which has a melting point around 44.5 Celsius;
- n-tetracosane $C_{23}$ which has a melting point around 52 Celsius;
- n-pentacosane $C_{23}$ which has a melting point around 54 Celsius;
- n-hexacosane $C_{26}$ which has a melting point around 56.5 Celsius;
- n-heptacosane $C_{27}$ which has a melting point around 59 Celsius;
- n-octacosane $C_{28}$ which has a melting point around 64.5 Celsius;
- n-nonacosane $C_{29}$ which has a melting point around 65 Celsius;
- n-triacosane $C_{30}$ which has a melting point around 66 Celsius;
- n-hentriacosane $C_{31}$ which has a melting point around 67 Celsius;
- n-dotriacosane $C_{32}$ which has a melting point around 69 Celsius;
- n-triatriacosane $C_{33}$ which has a melting point around 71 Celsius;
- paraffin $C_{22}$-$C_{45}$ which has a melting point around 58 to 60 Celsius;
- paraffin $C_{21}$-$C_{50}$ which has a melting point around 66 to 68 Celsius;
- RT 70 HC which has a melting point around 69 to 71 Celsius.

Alternatively, a salt hydrate such as $CH_3COONa \cdot 3H_2O$—which has a melting point around 58 Celsius, and latent heat of 226/265 kJ/kg may be used.

Thus far, the thermal energy store has largely been described as having a single mass of phase change material within a heat exchanger that has input and output circuits each in the form of one or more coils or loops. But it may also be beneficial in terms of rate of heat transfer for example, to encapsulate the phase change material in a plurality of sealed bodies—for example in metal (e.g. copper or copper alloy) cylinders (or other elongate forms)—which are surrounded by a heat transfer liquid from which the output circuit (which is preferably used to provide hot water for a (domestic) hot water system) extracts heat.

With such a configuration the heat transfer liquid may either be sealed in the heat exchanger or, more preferably, the heat transfer liquid may flow through the energy store and may be the heat transfer liquid that transfers heat from the green energy source (e.g. a heat pump) without the use of an input heat transfer coil in the energy store. In this way, the input circuit may be provided simply by one (or more generally multiple) inlets and one or more outlets, so that heat transfer liquid passes freely through the heat exchanger, without being confined by a coil or other regular conduit, the heat transfer liquid transferring heat to or from the encapsulated PCM and then on to the output circuit (and thus to water in the output circuit). In this way, the input circuit is defined by the one or more inlets and the one or more out for the heat transfer liquid, and the freeform path(s) past the encapsulated PCM and through the energy store.

Preferably the PCM is encapsulated in multiple elongate closed-ended pipes arranged in one or more spaced arrangements (such as staggered rows of pipes, each row comprising a plurality of spaced apart pipes) with the heat transfer fluid preferably arranged to flow laterally (or transverse to the length of the pipe or other encapsulating enclosure) over the pipes—either on route from the inlets to the outlets or, if an input coil is used, as directed by one or more impellers provided within the thermal energy store.

Optionally, the output circuit may be arranged to be at the top of the energy store and positioned over and above the encapsulated PCM—the containers of which may be disposed horizontally and either above an input loop or coil (so that convection supports energy transfer upwards through the energy store) or with inlets direction incoming heat transfer liquid against the encapsulated PCM and optionally towards the output circuit above. If one or more impellers is used, preferably the or each impeller is magnetically coupled to an externally mounted motor—so that the integrity of the enclosure of the energy store is not compromised.

Optionally the PCM may be encapsulated in elongate tubes, typically of circular cross section, with nominal external diameters in the range of 20 to 67 mm, for example 22 mm, 28 mm, 35 mm, 42 mm, 54 mm, or 67 mm, and typically these tubes will be formed of a copper suitable for plumbing use. Preferably, the pipes are between 22 mm and 54 mm, for example between 28 mm and 42 mm external diameter.

The heat transfer liquid is preferably water or a water-based liquid such as water mixed with one or more of a flow additive, a corrosion inhibitor, an anti-freeze, a biocide,—and may for example comprise an inhibitor of the type designed for use in central heating systems—such as Sentinel X100 or Fernox F1 (both RTM)—suitably diluted in water.

Thus, throughout the description and claims of the present application the expression input circuit should be construed, unless the context clearly requires otherwise, to include an arrangement as just described and in which the path of liquid flow from the input of the input circuit to its output is not defined by a regular conduit but rather involves the liquid flowing substantially freely within the enclosure of the energy store.

The PCM may be encapsulated in a plurality of elongate cylinders of circular or generally circular cross section, the cylinders preferably being arranged spaced apart in one or more rows. Preferably the cylinders in adjacent rows are offset with respect to each other to facilitate heat transfer from and to the heat transfer liquid. Optionally an input arrangement is provided in which heat transfer liquid is introduced to the space about the encapsulating bodies by one or more input ports which may be in the form of a plurality of input nozzles, that direct the input heat transfer liquid towards and onto the encapsulating bodies fed by an input manifold. The bores of the nozzles at their outputs may be generally circular in section or may be elongate to produce a jet or stream of liquid that more effectively transfers heat to the encapsulated PCM. The manifold may be fed from a single end or from opposed ends with a view to increasing the flow rate and reducing pressure loss.

The heat transfer liquid may be pumped into the energy store 12 as the result of action of a pump of the green energy source (e.g. a heat pump or solar hot water system), or of another system pump, or the thermal energy store may include its own pump. After emerging from the energy store at one or more outlets of the input circuit the heat transfer liquid may pass directly back to the energy source (e.g. the heat pump) or may be switchable, through the use of one or more valves, to pass first to a heating installation (e.g. underfloor heating, radiators, or some other form of space heating) before returning to the green energy source.

The encapsulating bodies may be disposed horizontally with the coil of the output circuit positioned above and over the encapsulating bodies. It will be appreciated that this is merely one of many possible arrangements and orientations. The same arrangement could equally well be positioned with the encapsulating bodies arranged vertically.

Alternatively an energy store using PCM encapsulation may again use cylindrical elongate encapsulation bodies such as those previously described, but in this case with an input circuit in the form of conduit for example in the form of a coil. The encapsulation bodies may be arranged with their long axes disposed vertically, and the input 14 and output 18 coils disposed to either side of the energy store 12. But again this arrangement could also be used in an alternative orientation, such as with the input circuit at the bottom and the output circuit at the top, and the encapsulation bodies with their long axes disposed horizontally. Preferably one or more impellers are arranged within the energy store 12 to propel energy transfer liquid from around the input coil 14 towards the encapsulation bodies. The or each impeller is preferably coupled via a magnetic drive system to an externally mounted drive unit (for example an electric motor) so that the enclosure of the energy store 12 does not need to be perforated to accept a drive shaft—thereby reducing the risk of leaks where such shafts enter the enclosure.

By virtue of the fact that the PCM is encapsulated it becomes readily possible to construct an energy store that uses more than one phase change material for energy storage, and in particular permits the creation of an energy storage unit in which PCMs with different transition (e.g. melting) temperatures can be combined thereby extending the operating temperature of the energy store.

It will be appreciated that in embodiments of the type just described the energy store 12 contains one or more phase change materials to store energy as latent heat in combination with a heat transfer liquid (such as water or a water/inhibitor solution).

A plurality of resilient bodies that are configured to reduce in volume in response to an increase in pressure caused by a phase change of the phase change material and to expand again in response to a reduction in pressure caused by a reverse phase change of the phase change material are preferably provided with the phase change material within the encapsulation bodies (they may also be used in energy banks using "bulk" PCMs as described elsewhere in this specification.

As previously described, with reference to FIG. 1, the state of the phase change material may be determined based on its internal pressure. A pressure transducer may be coupled to the processor of the interface unit. The processor of the interface unit therefore receives the signal relating to the degree of solidification/liquification of the phase change material—which provides information on an energy storage amount of the phase change material. The processor of the interface unit can be programmed during manufacture, or subsequently, based on empirical analysis of prototypes, so that the degree of solidification (more generally, the state) of the phase change material can be mapped to pressure signals from the pressure transducer. For example, preproduction prototypes may be fitted with a glass side panel so that the state of the phase change material can be determined by inspection/analysis, and the state mapped against pressure signals from the pressure transducer, knowledge of the latent heat of fusion of the phase change material being used will enable the amount of latent heat stored in the heat exchanger to be calculated for every pressure measured. Data obtained in this way can then be used in programming the processors for production interface unit, and in informing machine learning algorithms in this and potentially other processors in the system.

As also previously described, another method of monitoring the state of the phase change material which could be provided as an alternative to previously described methods, or in addition to one or more of these, would be to provide one or more optical sources to emit optical radiation into the body of phase change material for detection by one or more appropriately located optical sensors (an optical sensing arrangement). The one or more optical sources may operate on a single wavelength, or range of wavelengths (i.e., in effect a single colour), or could operate at two or more spaced apart wavelengths (i.e., different colours). The radiation may be in the visible or infrared regions of the spectrum, or both in the event that multiple colours of light are used. The optical source may be a source of incoherent light, such as an LED, or could be a laser, e.g., an LED laser. The optical source may be a single red-green-blue light emitting diode. The optical sensing arrangement may be coupled to a processor (e.g., the processor of the interface unit) which is configured to estimate an amount of energy stored in the phase change material based on information received from the optical sensing arrangement.

As also previously described, another method of monitoring the state of the phase change material which could be provided as an alternative to previously described methods, or in addition to one or more of these, would be to provide an acoustic source configured to launch sound into the phase change material within the heat exchanger, and an acoustic sensing arrangement to detect sound launched from the acoustic source after the sound has passed through the phase change material. Preferably, the acoustic source is configured to produce ultrasound.

The invention claimed is:

1. A hot water supply system including:

a processor;

a controllable hot water supply outlet having when fully opened a given flowrate, the controllable hot water supply outlet being configured to receive hot water from a hot water supply line having a valve therein;

a renewable energy source comprising a solar water heating arrangement or a heat pump, the renewable energy source being configured to be able to receive water and to heat the received water to be supplied to the controllable hot water supply outlet via the valve in the hot water supply line;

a thermal energy store, containing a thermal storage medium to store thermal energy, that is configured to receive energy from the renewable energy source and to be able to receive water and to heat the received water to be supplied to the controllable hot water supply outlet via the valve in the hot water supply line;

an auxiliary water heater intermediate the valve in the hot water supply line and the controllable hot water supply outlet;

the hot water supply system being operable, under the control of the processor, to heat water that is to be supplied to the hot water outlet to a target system supply temperature using a selection of one or more of the renewable energy source, the thermal energy store, and the auxiliary water heater;

wherein the thermal energy store has an energy storage capacity, when fully charged, that is sufficient to provide hot water to the controllable hot water supply outlet, at the given flowrate, and at the target system supply temperature for a period of at least 8 minutes;

wherein the renewable energy source is also configured to provide building heating under control of the processor, the processor being configured to:

monitor actual demand for hot water from the hot water supply system;

predict future demand for hot water from the hot water supply system based on the monitored actual demand;

pre-charge the thermal energy store so that sufficient energy will be stored in the thermal energy store to satisfy the predicted demand; and temporarily divert heat from the renewable energy source to charge the thermal storage medium rather than to provide building heating.

2. The hot water supply system of claim 1, wherein the thermal energy store includes an electrical heating element to enable the thermal storage medium to be charged using heat from the electrical heating element.

3. The hot water supply system of claim 1, wherein the processor is configured to decide when and how much to charge the thermal storage medium based on the predicted future demand and taking account of the cost of the energy to be used.

4. The hot water supply system of claim 1, wherein the processor is configured to use data from one or more occupancy sensors in predicting future demand for hot water from the hot water supply system.

5. The hot water supply system of claim 1, wherein the processor is configured to use forecast weather information in predicting future demand for hot water from the hot water supply system.

6. The hot water supply system of claim 1, wherein the processor is configured to use data from one or more ambient temperature sensors in predicting future demand for hot water from the hot water supply system.

7. The hot water supply system of claim 1, wherein the hot water supply system serves a single household, and the processor is configured to use calendar and schedule information of occupants of the household in predicting future demand for hot water from the hot water supply system.

8. A method of controlling a heating appliance in a hot water supply system, the hot water supply system having a controllable hot water supply outlet having when fully opened a given flowrate, the controllable hot water supply outlet being configured to receive hot water from a hot water supply line having a valve therein, and the heating appliance including:

a processor;

a renewable energy source comprising a solar water heating arrangement or a heat pump, the renewable energy source being configured to be able to receive cold water and to heat it to be supplied to the controllable hot water supply outlet via the valve in the hot water supply line;

a thermal energy store, containing a thermal storage medium to store thermal energy, that is configured to receive energy from the renewable energy source and to be able to receive water and to heat it to be supplied to the controllable hot water supply outlet via the valve in the hot water supply line;

an auxiliary water heater intermediate the valve in the hot water supply line and the controllable hot water supply outlet;

the hot water supply system being operable, under the control of the processor, to heat water that is to be supplied to the controllable hot water supply outlet to a target system supply temperature using a selection of one or more of the renewable energy source, the thermal energy store, and the auxiliary water heater;

wherein the thermal energy store has an energy storage capacity, when fully charged, that is sufficient to provide hot water to the controllable hot water supply outlet, at the given flowrate, and at the target system supply temperature for a period of at least 8 minutes; and wherein the renewable energy source is also configured to provide building heating under control of the processor, the method comprising:

monitoring actual demand for hot water from the hot water supply system;

predicting future demand for hot water from the hot water supply system based on the monitored actual demand;

pre-charging the thermal energy store so that sufficient energy will be stored in the thermal energy store to satisfy the predicted demand; and temporarily diverting heat from the renewable energy source to charge the thermal storage medium rather than to provide building heating.

9. The method of claim 8, the method further comprising using an electrical heating element within the thermal energy store to charge the thermal storage medium using heat from the electrical heating element.

10. The method of claim 8, the method further comprising deciding when and how much to charge the thermal storage medium based on the predicted future demand, and taking account of the cost of the energy to be used.

11. The method of claim 8, the method further comprising using data from one or more occupancy sensors in predicting future demand for hot water from the hot water supply system.

12. The method of claim 8, the method further comprising using forecast weather information in predicting future demand for hot water from the hot water supply system.

13. The method of claim 8, the method further comprising using data from one or more ambient temperature sensors in predicting future demand for hot water from the hot water supply system.

14. The method of claim 8, wherein the hot water supply system serves a single household, the method further comprising using calendar and schedule information of occupants of the household in predicting future demand for hot water from the hot water supply system.

* * * * *